US006081679A

United States Patent [19]

Yamane et al.

[11] Patent Number: 6,081,679

[45] Date of Patent: Jun. 27, 2000

[54] METHOD OF CLEANING RESIDUAL TONER FROM DRUM AND ROLLERS OF IMAGE FORMING APPARATUS

[75] Inventors: Tsutomu Yamane; Akihito Onishi; Hirokazu Ando; Takao Mizutani; Masao Isoda, all of Tokyo, Japan

[73] Assignee: Oki Data Corporation, Tokyo, Japan

[21] Appl. No.: 09/396,793

[22] Filed: Sep. 15, 1999

[30] Foreign Application Priority Data

Sep. 16, 1998 [JP] Japan ..... 10-261384

[51] Int. Cl.[7] ..... G03G 15/02

[52] U.S. Cl. ..... 399/71; 399/50; 399/100; 399/343

[58] Field of Search ..... 399/343, 50, 71, 399/149, 98, 99, 100, 101; 730/126

[56] References Cited

U.S. PATENT DOCUMENTS 5,517,289 5/1996 Ito et al. ..... 399/149
5,740,494 4/1998 Shoji et al. ..... 399/71

*Primary Examiner*—Quana Grainger

*Attorney, Agent, or Firm*—Rabin & Champagne, P.C.

[57] ABSTRACT

A method for cleaning an image-forming apparatus. Toner is charged to the first polarity prior to transferring the toner image to the print medium and accidentally inverted from the first polarity to a second polarity opposite to the first polarity during the transfer of the toner image to the print medium. When performing a cleaning operation, a first voltage of a first polarity is applied to at least one of a charging roller and a cleaning roller in contact with a surface of a photoconductor. The surface of the photoconductor is charged to a second voltage. The second voltage has a smaller value than the first voltage and is of the same polarity as the first voltage. Therefore, the toner of the second polarity sandwiched between the charged surface of the photoconductor and the at least one of the charging roller and cleaning roller is inverted in polarity, i.e., from the second polarity to the first polarity by triboelectric charging. If the first voltage is applied to the cleaning roller, the photoconductor may be charged to the second voltage by a transfer device or by a charging device. Alternatively, if the first voltage is applied to the charging roller, the photoconductor may be charged to the second voltage by a cleaning device or by the transfer device.

13 Claims, 16 Drawing Sheets

+400V
-1300V
t=t1
TONER PASSES CLEANING ROLLER
0V
-1300V
t1
t
t2
t3
TONER PASSES CHARGING ROLLER
0V
-1300V
t
t2
TONER IS COLLECTED
1
2
5
8
10
A
B
C
D
E

TONER MIGRATES TO DRUM
+1000V
-1100V
t
t6

TONER PASSES CLEANING ROLLER
+400V
-300V
t6
t
t10

TONER PASSES CHARGING ROLLER
0V
-1300V
t4
t

TONER IS COLLECTED
0V
-300V
t7
t
t8

METHOD OF CLEANING RESIDUAL TONER FROM DRUM AND ROLLERS OF IMAGE FORMING APPARATUS

BACKFGROUND OF THE INVENTION

The present invention relates to a structure of an electrophotography type image forming apparatus and a method for cleaning an electrophotography apparatus.

DESCRIPTION OF THE RELATED ART

One electrophotography type image forming apparatus is of a type in which an image bearing body or photoconductor such as a photoconductive drum, a photoconductive belt, etc. is contact-charged.

FIG. 2 illustrates this type of image forming apparatus.

The operation of the image forming apparatus will be described. A photoconductive drum and respective rollers are driven in rotation by motors, not shown, and a print medium is fed by a feeding mechanism, not shown.

The charged surface of the photoconductive drum 1 rotates in a direction shown by arrow A, to a location immediately under the latent image writing device 4. The latent image writing device illuminates the negatively charged surface of the photoconductive drum 1 in accordance with an image to be written. The potential of illuminated areas becomes nearly zero volts and that of not-illuminated areas remains negative.

After having a latent image formed thereon, the surface of the photoconductive drum 1 further rotates in the direction shown by arrow A and is brought into contact with a developing roller 5. The developing roller 5 receives a negative voltage from a power supply 6 and rotates in pressure contact with the photoconductive drum 1 in a direction shown by arrow C. The toner on the developing roller 5 is converted into a thin layer by a toner applicator 7. The thin layer of toner is brought into contact with the latent image formed on the photoconductive drum 1, thereby developing the latent image into a toner image. This development is reversal development in which the toner is of the same polarity as the uniformly charged surface of the photoconductive drum 1.

The toner image formed on the photoconductive drum 1 reaches a transfer unit where a transfer roller 8 receives a positive voltage from a power supply 9 and rotates in pressure contact with the photoconductive drum 1 in a direction shown by arrow D. The toner image is then transferred to print medium 12 that feeds in a direction shown by arrow G. The print medium 12 is then separated from the photoconductive drum 1 and then fed into a fixing unit, not shown, where the toner image is fused into a permanent image. The print medium 12 is then discharged as a permanent print.

After the transfer operation, some toner remains as a residual toner on the surface of the photoconductive drum 1. The photoconductive drum 1 further rotates so that the surface having the residual toner thereon is brought into contact with the cleaning roller 10. When the cleaning roller 10 receives a positive voltage from a power supply 11, the cleaning roller 10 attracts the residual toner on the photoconductive drum 1, thereby removing the residual toner from the photoconductive drum 1. The photoconductive drum further rotates in the direction shown by arrow A so that the cleaned surface is again subjected to the charging operation. During the printing process, some polarity-inverted toner may adhere to the photoconductive drum 1.

The polarity-inverted results when the toner layer is formed on the developing roller 5 or when the toner image is transferred to the print medium 12.

The Coulomb force attracts the polarity-inverted toner adhering to the photoconductive drum 1 to the charging roller 2 during the charging operation. As a result, the polarity-inverted toner is deposited on the charging roller 2. For this reason, the apparatus is designed to enter a cleaning sequence every time one page of print medium has been printed.

The cleaning sequence of the apparatus will be described.

FIG. 19 is a timing chart illustrating the cleaning sequence of the image forming apparatus shown in FIG. 2.

At time t1, the output of the power supply 9 is switched from a positive voltage to zero volts. The surface of the photoconductive drum 1 which was in contact with the transfer roller 8 rotates in the direction shown by arrow A and reaches the cleaning roller 10 at time t2. The output of the power supply 11 is switched to a negative voltage so that the cleaning roller 10 now receives the negative voltage. The negative output voltage of the power supply 11 is selected to be a value close to the negative output voltage of the power supply 3. Thus, the surface of the photoconductive drum 1 in contact with the charging roller 2 is uniformly charged to a potential close to a value when the surface of the photoconductive drum 1 contacts the charging roller 2.

Non-transferred toner (negatively charged) remaining on the cleaning roller 10 migrates by the Coulomb force to the photoconductive drum 1. The surface of the photoconductive drum 1 having the non-transferred toner thereon rotates in the direction shown by arrow A to an angular position where the surface is brought into contact with the charging roller 2. Since the charging roller 2 receives a negative voltage from the power supply 3, the non-transferred toner remains on the photoconductive drum 1 due to the Coulomb force. The photoconductive drum further rotates in the direction shown by arrow A so that the surface of the photoconductive drum with non-transferred toner is brought into contact with the developing roller 5. Since the developing roller 5 receives a voltage closer to zero volts than the surface potential of the photoconductive drum 1, the non-transferred toner migrates due to the Coulomb force to the developing roller 5. In this manner, the non-transferred toner is collected.

At time t3, the negative output voltage of the power supply 3 is switched to zero volts. The surface of the photoconductive drum 1 upstream of the charging roller 2 is negatively charged since the power supply 11 supplies a negative voltage to the cleaning roller 10. Therefore, the Coulomb force attracts polarity-inverted toner on the charging roller 2 to the photoconductive drum 1. The surface with the polarity-inverted toner thereon rotates in the direction shown by arrow A to the developing roller 5. At time t4 immediately before the surface of the photoconductive drum 1 with the polarity-inverted toner thereon comes into contact with the developing roller 5, the power supply 6 switches its output voltage from a negative voltage to zero volts. Thus, the polarity-inverted toner on the photoconductive drum 1 receives the Coulomb force acting toward the photoconductive drum, so that the surface with the polarity-reversed toner thereon merely passes the developing roller 5.

The Coulomb force attracts non-transferred toner on the photoconductive drum 1 to the developing roller 5. The surface having the non-transferred toner thereon rotates in the direction shown by arrow A and is brought into contact with the transfer roller 8. At time t5 immediately before the surface comes into contact with the transfer roller 8, the output voltage of the power supply 9 is switched from zero volts to a positive voltage. Thus, the polarity-reversed toner on the photoconductive drum 1 merely passes the transfer roller 8 and further rotates to the cleaning roller 10. Since the power supply 11 supplies a negative voltage to the cleaning roller 10, the Coulomb force attracts the polarity-inverted toner on the photoconductive drum 1 to the cleaning roller 10.

Time duration $T_{CH}$ during which the power supply provides zero volts to the charging roller 2 should be at least longer than a time duration required for the charging roller 2 to make a complete one rotation.

Then, at time t6, the output of the power supply 3 is switched from zero volts to a negative voltage. Likewise, at time t7, the output of the power supply 6 is switched from zero volts to a negative voltage, and at time t8, the output of the power supply 9 is switched from a positive voltage to zero voltage.

By repeating the above-described sequence, the cleaning roller 10 receives the polarity-inverted toner, thereby reducing an amount of polarity-inverted toner deposited on the charging roller 2.

Another conventional apparatus is one in which a metal auxiliary roller rotates in pressure contact with the charging roller 2, and the charging roller 2 and the auxiliary roller receive the same voltage from the same power supply. The charging roller 2 has a resilient layer made of electrically conductive rubber so that a voltage drop is developed between the auxiliary roller and the shaft of the charging roller 2, the voltage drop corresponding to the resistance of the resilient layer.

The polarity-inverted toner is of a positive polarity. Thus, the polarity-reversed toner on the charging roller 2 migrates to the auxiliary roller due to the potential between the charging roller and the auxiliary roller. The polarity-inverted toner on the auxiliary roller is gradually charged to a negative polarity due to the auxiliary roller and then the negatively charged toner returns to the charging roller 2, then to the photoconductive drum 1, and finally to the developing roller 5.

With the apparatus of the aforementioned construction, the cleaning operation is not sufficiently effective and therefore adversely affects the print quality. If the toner is not charged to a sufficient potential for a voltage applied, the amount of polarity-inverted toner deposited on the photoconductive drum per unit time increases. Thus, it is difficult to sufficiently remove the polarity-inverted toner.

When a printing operation is performed after the cleaning sequence, toner such as non-transferred toner deposited on the transfer roller adheres to the backside of the print medium. Thus, the soiling of the print is inevitable.

Another drawback is that after the cleaning operation, the toner that was once removed by the cleaning operation again adheres to the charging roller. This causes variations in the potential of the charged surface of the photoconductive drum 1, resulting in an image with inconsistency in density.

Since the difference in potential between the char ging roller 2 and the auxiliary roller is not large, the toner on the charging roller 2 cannot be removed sufficiently. As a result, repeated printing operations cause the toner deposited on the charging roller 2 to be crushed into a thin film of toner that behaves as an insulating layer. The insulating layer does not allow uniform charging of the photoconductive drum 1.

SUMMARY OF THE INVENTION

An object of the present invention is to provide a cleaning sequence more effective in removing residual toner.

A method is used for cleaning an image-forming apparatus and comprises. Toner is charged to the first polarity (e.g., negative) prior to transferring the toner image to the print medium. Some of the charged toner is accidentally inverted from the first polarity to a second polarity (e.g., positive) opposite to the first polarity during the transfer of the toner image to the print medium.

When a cleaning operation is performed, a first voltage of a first polarity is applied to at least one of a charging roller and a cleaning roller in contact with a surface of a photoconductor. The surface of the photoconductor is charged to a second voltage. The second voltage has a smaller value than the first voltage and is of the same polarity as the first voltage. Therefore, the toner of the second polarity sandwiched between the charged surface of the photoconductor and the at least one of the charging roller and cleaning roller is inverted in polarity, i.e., from the second polarity to the first polarity by triboelectric charging.

If the first voltage is applied to the cleaning roller, the photoconductor may be charged to the second voltage by a transfer device or by a charging device. Alternatively, if the first voltage is applied to the charging roller, the photoconductor may be charged to the second voltage by a cleaning device or by the transfer device.

Another method is used for cleaning an image forming apparatus having a photoconductor, a charging roller, developing roller, transfer roller, and cleaning roller. The drum and rollers rotate in predetermined directions and receive corresponding voltages in sequence as the photoconductor rotates. A first toner of a first polarity adhering to the cleaning roller is caused by Coulomb force to migrate to the surface of the photoconductor. The surface of the photoconductor passes the charging roller while carrying the first toner on the surface of the photoconductor and reaches the developing roller. A second toner of a second polarity opposite to the first polarity adhering to the charging roller is caused by Coulomb force to migrate to the surface of the photoconductor. The surface of the photoconductor passes the developing roller and transfer roller while carrying the second toner on the surface of the photoconductor and reaches the cleaning roller. The cleaning roller converts the second toner into a third toner of the first polarity. A fourth toner of the first polarity adhering to the transfer roller is caused by Coulomb force to migrate to the surface of the photoconductor. The surface of the photoconductor passes the cleaning roller and charging roller while carrying the fourth toner of the first polarity on the photoconductor and reaches the developing roller. The first toner, second toner, third toner, and fourth toner are collected with the developing roller.

The cleaning may be performed after each sheet of print medium has been printed or after a certain number of pages of print medium have been printed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

First embodiment

Figure 1:
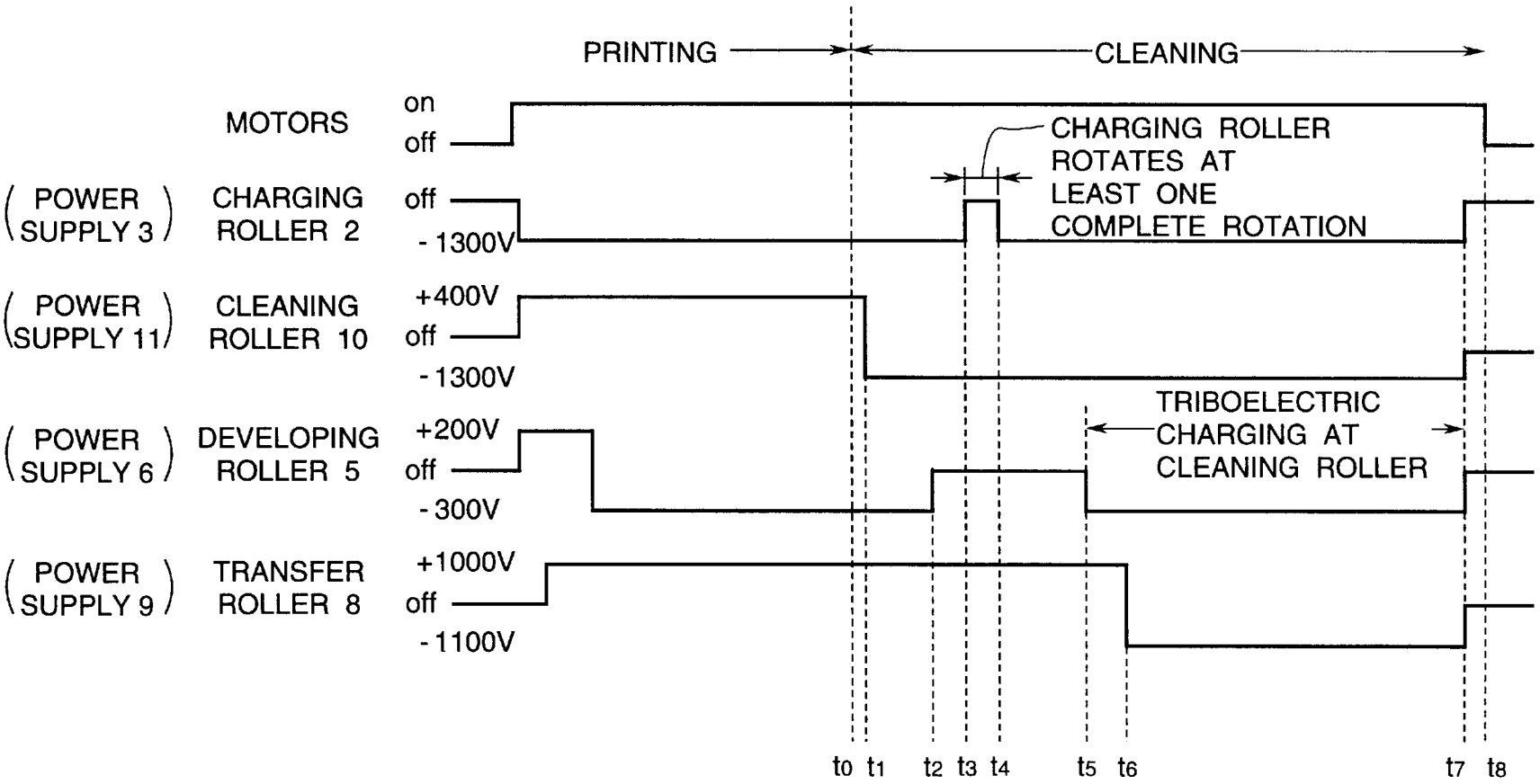
FIG. 1 is a timing chart illustrating a cleaning sequence performed by a microcomputer-based controller according to a first embodiment.
Figure 2:
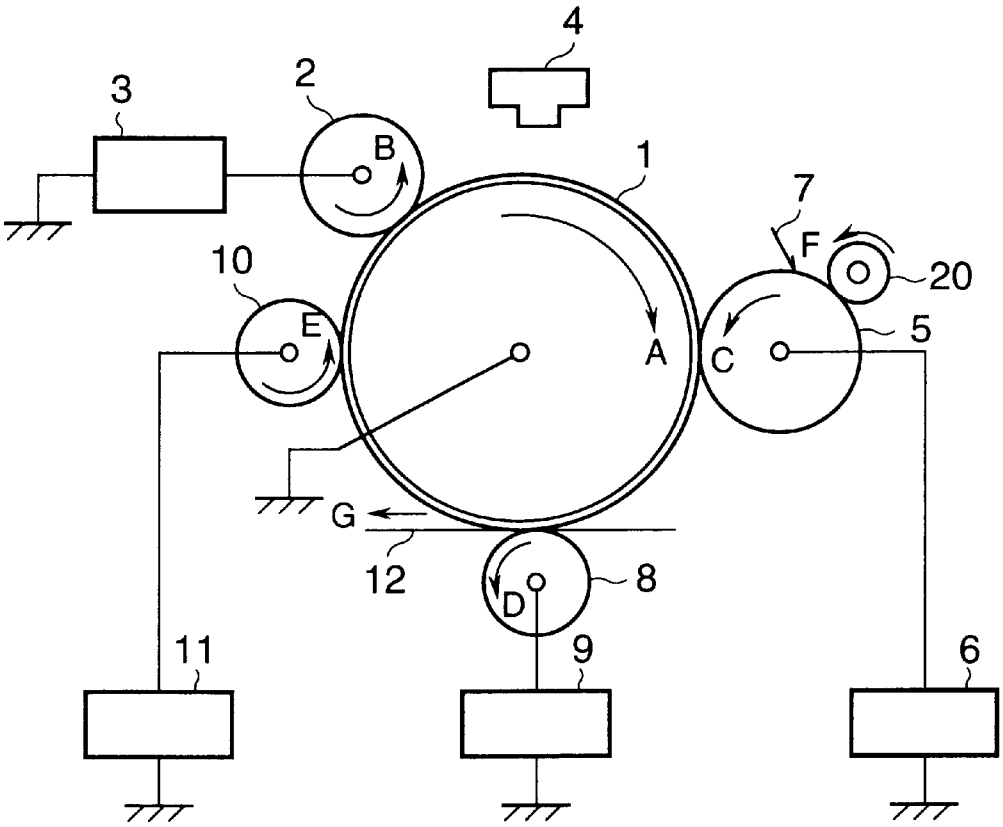
FIG. 2 illustrates the structure of an image forming apparatus according to the present invention and the conventional art.

The structural elements of the first embodiment are the same as those of the apparatus shown in FIG. 2. FIG. 1 is a timing chart illustrating a cleaning operation performed by a microcomputer-based controller, not shown. The cleaning sequence will be described with reference to FIGS. 1, 2, 3A–3C, and 4A–4F. The cleaning operation according to the first embodiment is performed at the end of the printing of each page.

Collecting non-transferred toner

Figures 3A, 3B, 3C:
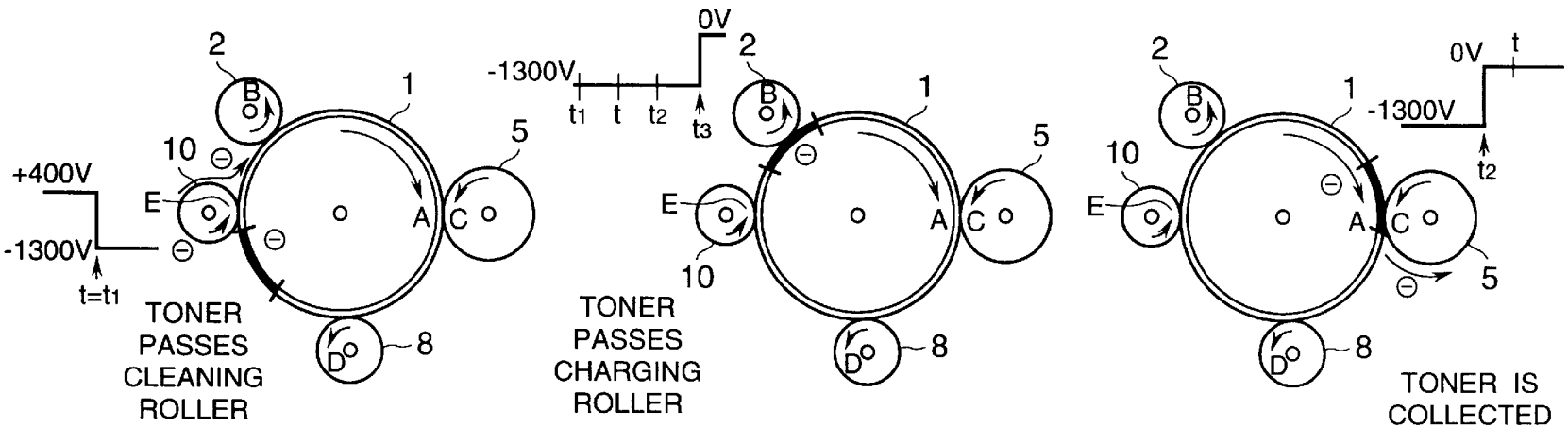
FIGS. 3A–3C illustrate the migration of non-transferred toner.

FIGS. 3A–3C illustrates the migration of non-transferred toner.

After printing one page of print medium, the output voltage of the power supply 11 for cleaning roller 10 is switched at time t1 from +400 V to −1300 V. Then, non-transferred toner (i.e., residual negatively charged toner) is attracted by the Coulomb force from the cleaning roller 10 to the surface of a photoconductive drum 1 as shown in FIG. 3A. The surface of the photoconductive drum 1 rotates in a direction shown by arrow A and comes into contact with the charging roller 2.

Since the charging roller 2 is receiving −1300 V from the power supply 3, the non-transferred toner on the photoconductive drum 1 continues to adhere to the photoconductive drum 1 due to the Coulomb force and the non-transferred toner passes the charging roller as shown in FIG. 3B.

The photoconductive drum 1 further rotates in the direction shown by arrow A and the surface on which the non-transferred toner adheres comes into contact with the developing roller 5 at time t2. At this time point, the power supply 6 switches its output voltage from −300 V to zero volts. Therefore, the potential difference between the photoconductive drum 1 and the developing roller 5 becomes large, so that the non-transferred toner on the photoconductive drum 1 migrates from the photoconductive drum 1 to the developing roller 5 as shown in FIG. 3C. A toner-supplying roller 20 is driven in rotation in contact with the developing roller 5. The toner-supplying roller 20 scratches the non-transferred toner from the developing roller 5. The supplying roller 20 will be described later.

The power supply 3 switches its output voltage from −1300 V to zero volts at time t3 after the non-transferred toner has passed the charging roller 2. Thus, the non-transferred toner does not adhere to the charging roller 2. If a relatively large amount of toner is deposited on the cleaning roller 10, then the time t3 may be delayed so that the power supply 3 switches its output voltage after the cleaning roller 10 has made, for example, complete two rotations.

Collecting polarity-inverted toner

FIGS. 4A–4F illustrates the migration of polarity-inverted toner as the photoconductive drum 1 rotates.

When the cleaning roller 10 receives −1300 V at time t1, the photoconductive drum 1 has been negatively charged. After the surface of the photoconductive drum 1 having the non-transferred toner thereon has rotated away from the charging roller 2, the power supply 3 switches its output voltage at time t3 from −1300 V to zero volts. Thus, the Coulomb force attracts polarity-inverted toner on the charging roller 2 to the photoconductive drum 1.

Figure 4A:
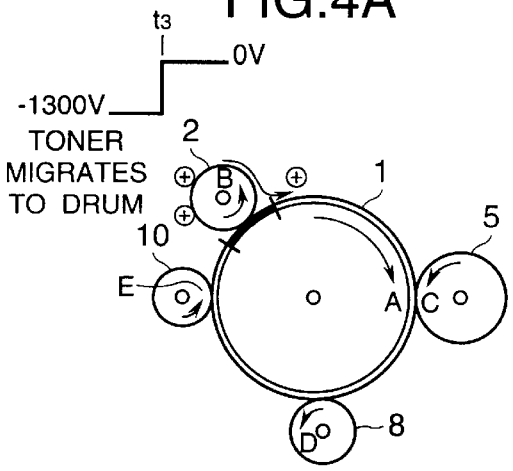
FIGS. 4A–4F illustrate the migration of polarity-inverted toner in the first embodiment.
Figure 4B:
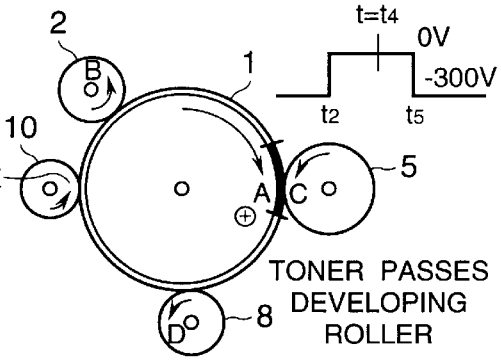

Since the charging roller 2 is receiving zero volts, the surface of the photoconductive drum 1 that has passed the charging roller 2 is also nearly zero volts. The charging roller 2 should receive zero volts for at least a length of time during which the charging roller 2 makes one complete rotation. If a relatively large amount of polarity-inverted toner adheres to the charging roller 2, the charging roller 2 should receive zero volts for a longer time during which the charging roller 2 makes, for example, two or more complete rotations. As shown in FIG. 4B, the surface having the polarity-inverted toner deposited thereon reaches the developing roller 5 as the photoconductive drum 1 rotates in the direction shown by arrow A. Since the surface of the photoconductive drum 1 is nearly zero volts, the power supply 6 continues to apply zero volts to the developing roller 5 so that the polarity-inverted toner on the photoconductive drum 1 remains thereon due to the Coulomb force.

Figure 4C:
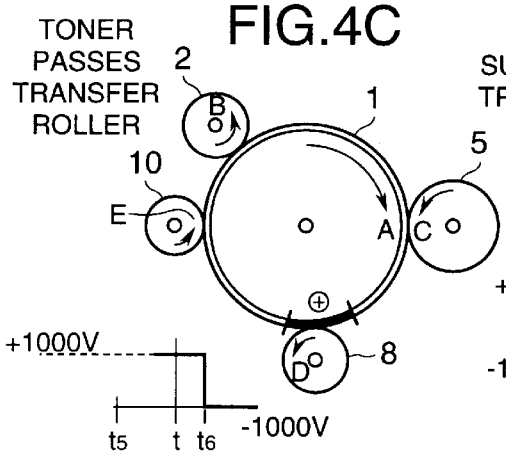

As the photoconductive drum 1 rotates further in the direction shown by arrow A, the surface having the polarity-inverted toner thereon comes into contact with the transfer roller 8 as shown in FIG. 4C. The transfer roller 8 is receiving +1000 V from the power supply 9 and therefore the polarity-inverted toner on the photoconductive drum 1 remains thereon due to the Coulomb force. It is to be noted that the power supply 3 provides zero volts to the charging roller 2 at time t3 and −1300 V at time t4 after the charging roller 2 has made at least one complete rotation. The output of the power supply 6 is switched from zero volts to −300 V at time t5 after the surface of the photoconductive drum has passed the developing roller 5. Likewise, the output of the power supply 9 is switched from +1000 V to −1100 V at time t6.

The transfer roller 8 receives +1000 V until time t6, and therefore, some of the negatively charged residual toner remains on the transfer roller 8 until time t6. When the transfer roller 8 receives −1100 V at time t6, the negatively charged toner on the transfer roller 8 migrates to the photoconductive drum by the Coulomb force. Then the negatively charged toner is carried to the developing roller 5 as the photoconductive drum 1 rotates and is collected by the developing roller 5 by time t7.

Figure 4D:
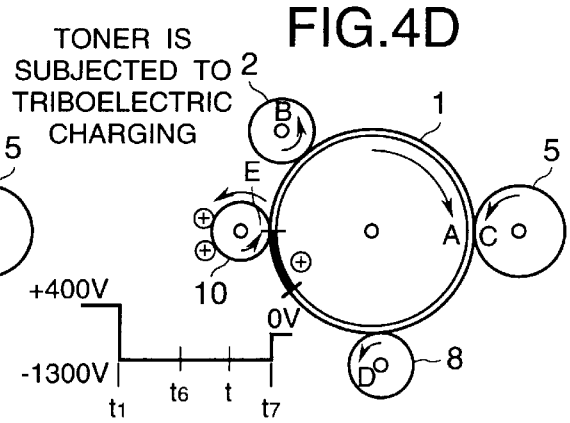
Figure 4E:
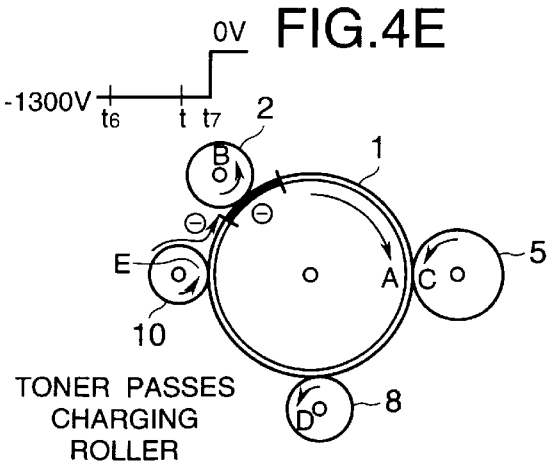
Figure 4F:
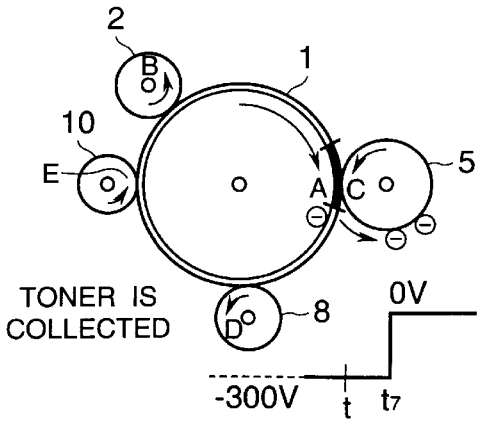

When the transfer roller 8 receives −1100 V at time t6, the transfer roller 8 charges the photoconductive drum 1 to a negative potential. Then, the negatively charged surface of the photoconductive drum 1 comes into contact with the cleaning roller 10 as shown in FIG. 4D, so that the polarity-inverted toner adhering to the cleaning roller 10 is inverted in polarity into negatively charged toner by triboelectric charging. This toner, inverted into negatively charged toner, migrates to the photoconductive drum 1 by the Coulomb force and then passes the charging roller 2 since the charging roller is receiving −1300 V. Then, the surface is further carried to the developing roller 5, which in turn collects the toner by time t7 as shown in FIG. 4F. In order to collect as large an amount of toner as possible, the duration from time t6 to time t7 during which the toner is subjected to triboelectric charging should be as long as possible unless the overall printing performance is deteriorated. The motors come to stop at a time t8 at which the cleaning sequence is complete. The cleaning sequence is carried out during a duration from when the trailing end of the print medium passes the transfer roller 8 till the print medium is discharged out of the apparatus.

If the speed of the cleaning roller 10 on which the polarity-inverted toner is deposited is set to 0.9 to 1.1 times that of the photoconductive drum 1, then polarity-inverted toner can be more efficiently converted into normally charged (negatively charged) toner by triboelectric charging.

As described above, according to the first embodiment, the apparatus enters the cleaning sequence at the end of the printing of one page. That is, the charging roller receives zero volts so that the reverse-polarity charged toner on the charging roller 2 migrates via the photoconductive drum 1 to the cleaning roller 10. Then, the polarity-inverted toner is inverted in polarity back to normally charged toner (i.e., negatively charged toner) by triboelectric charging, and finally collected by the developing roller 5.

The transfer roller 8 receives −1100 V, so that the transfer roller 8 releases the negatively charged residual toner deposited on the transfer roller 8 during the printing cycle and cleaning sequence. Thus, the transfer roller 8 is cleaned.

Second embodiment

The second embodiment differs from the first embodiment in that a cleaning sequence is performed every time a certain number of pages have been printed in continuous printing.

Figure 6:
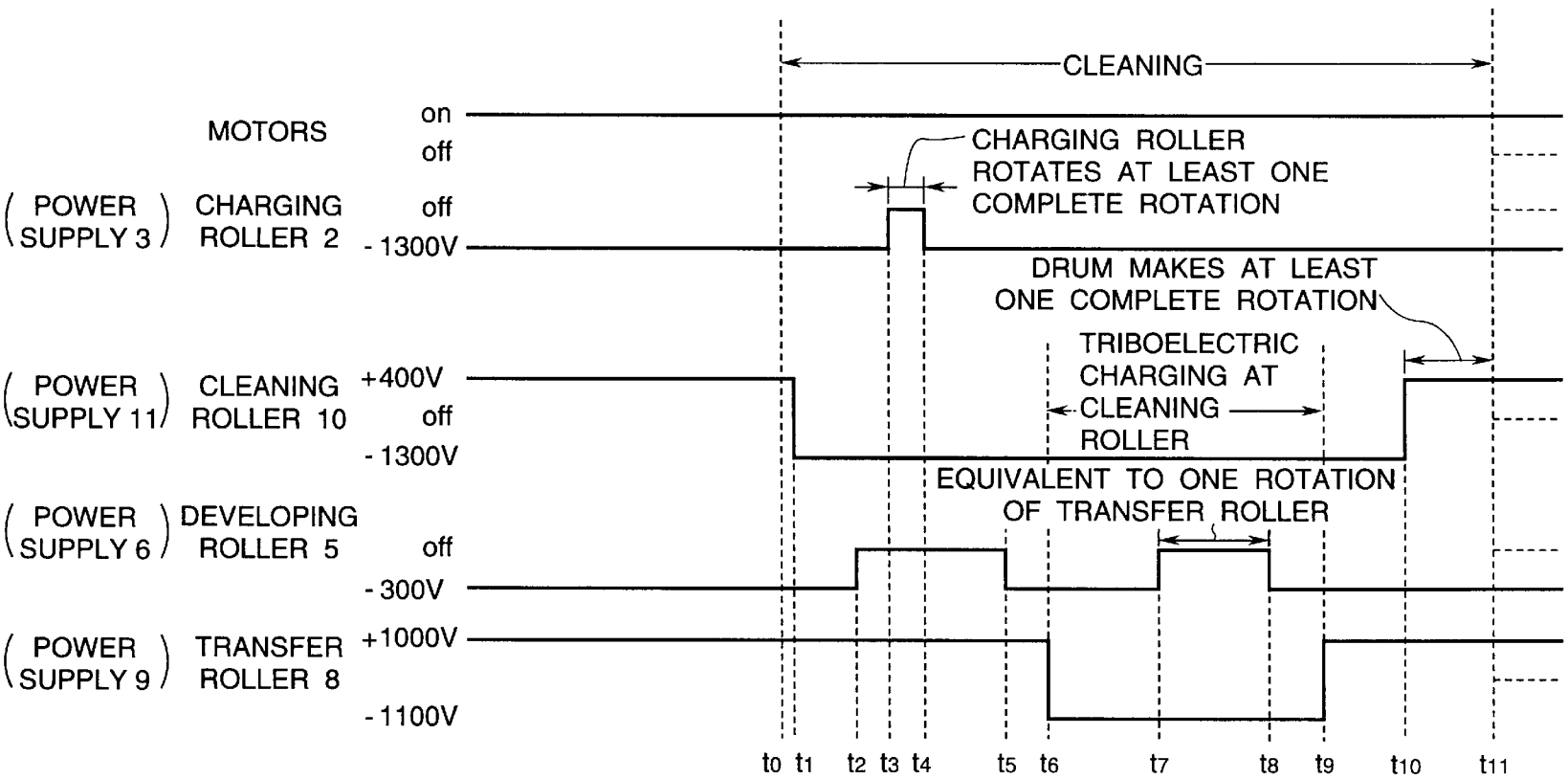
FIG. 6 is a timing chart illustrating the cleaning sequence of a second embodiment.

FIG. 6 is a timing chart illustrating the cleaning sequence of the second embodiment.

Collecting non-transferred toner remaining on the cleaning roller

For continuous printing, after a certain number of pages have been printed, the apparatus enters the cleaning sequence shown in FIG. 6. The output of the power supply 11 for the cleaning roller 10 is switched from +400 V to −1300 V. Thus, the photoconductive drum 1 attracts by the Coulomb force negatively charged non-transferred toner remaining on the photoconductive drum.

The surface of the photoconductive drum 1 on which the non-transferred toner remains comes into contact with the charging roller 2 as the photoconductive drum rotates in the direction shown by arrow A. Since the charging roller 2 is receiving −1300 V from the power supply 3, the non-transferred toner continues to adhere to the surface of the photoconductive drum 1. The photoconductive drum 1 further rotates, so that the surface with the non-transferred toner thereon reaches the developing roller 5 at time t2. The output of the power supply 6 is switched from −300 V to zero volts. Thus, the electric field between the photoconductive drum 1 and developing roller 5 becomes high to produce a Coulomb force, which causes the non-transferred toner on the photoconductive drum 1 to migrate to the developing roller 5. The supply roller 20 in contact with the developing roller 5 is driven in rotation, scratching the non-transferred toner from the developing roller 5 so that the non-transferred toner is collected into the developing unit.

As mentioned above, the output of the power supply 11 is switched from +400 V to −1300 V at time t1 so that the cleaning roller 10 releases the non-transferred toner to the photoconductive drum 1. The non-transferred toner corresponding to one complete rotation of the cleaning roller 10 is transferred to the photoconductive drum 1. After the non-transferred toner has passed the charging roller 2, the output of the power supply 3 is switched at time t3 from −1300 V to zero volts. If a large amount of non-transferred toner adheres to the cleaning roller 10, the time t3 may of course be delayed to timing such that the cleaning roller 10 makes, for example, two complete rotations.

When the cleaning roller 10 receives −1300 V at time t1 from the power supply 11, the photoconductive drum 1 is negatively charged. When the output of the power supply 3 is switched from −1300 V to zero volts, the Coulomb force attracts the polarity-inverted toner to the negatively charged surface of the photoconductive drum 1. Since the charging roller 2 is receiving zero volts, the photoconductive drum 1 is charged to nearly zero volts. The charging roller 2 should receive zero volts for at least a period required for one complete rotation of the charging roller 2. If a large amount of polarity-inverted toner adheres to the charging roller 2, the time t3 may be delayed to timing such that the charging roller 2 makes two, three, or more complete rotations.

As the photoconductive drum 1 rotates in the direction shown by arrow A, the surface of the photoconductive drum on which the polarity-inverted toner remains will reach the developing roller 5. At this time point, the photoconductive drum 1 is nearly zero volts, and thus the power supply 6 continues to supply zero volts to the developing roller 5 so as to avoid unnecessary developing. The polarity-inverted toner on the photoconductive drum 1 continues to adhere to the photoconductive drum 1 due to the Coulomb force and the photoconductive drum 1 further rotates in the direction shown by arrow A so that the polarity-inverted toner reaches the transfer roller 8. Since the transfer roller 8 is receiving +1000 V from the power supply 9, the polarity-inverted toner on the photoconductive drum 1 still continues to adhere to thereto. The photoconductive drum 1 further rotates and reaches the cleaning roller 10.

Since the cleaning roller 10 is receiving −1300 V from the power supply 11, the polarity-inverted toner is attracted by the Coulomb force to the cleaning roller 10. After the charging roller 2 has made more than one complete rotation, the output of the power supply 3 is switched from zero volts to −1300 V at time t4. Likewise, after the photoconductive drum 1 has passed the developing roller 5 at time t4, the output of the power supply 6 is switched from zero volts to −300 V at time t5. Also, after the photoconductive drum has passed the transfer roller 8, the output of the power supply 9 for the transfer roller 8 is switched from +1000 V to −1100 V at time t6.

Collecting of negatively charged toner from the transfer roller (t6–t8)

FIGS. 5A–5D illustrate the operation for collecting negatively charged toner from the transfer roller 8.

The collection of negatively charged toner after t6 will be described with reference to FIGS. 5A–5D and FIG. 6.

Figures 5A, 5B, 5C, 5D:
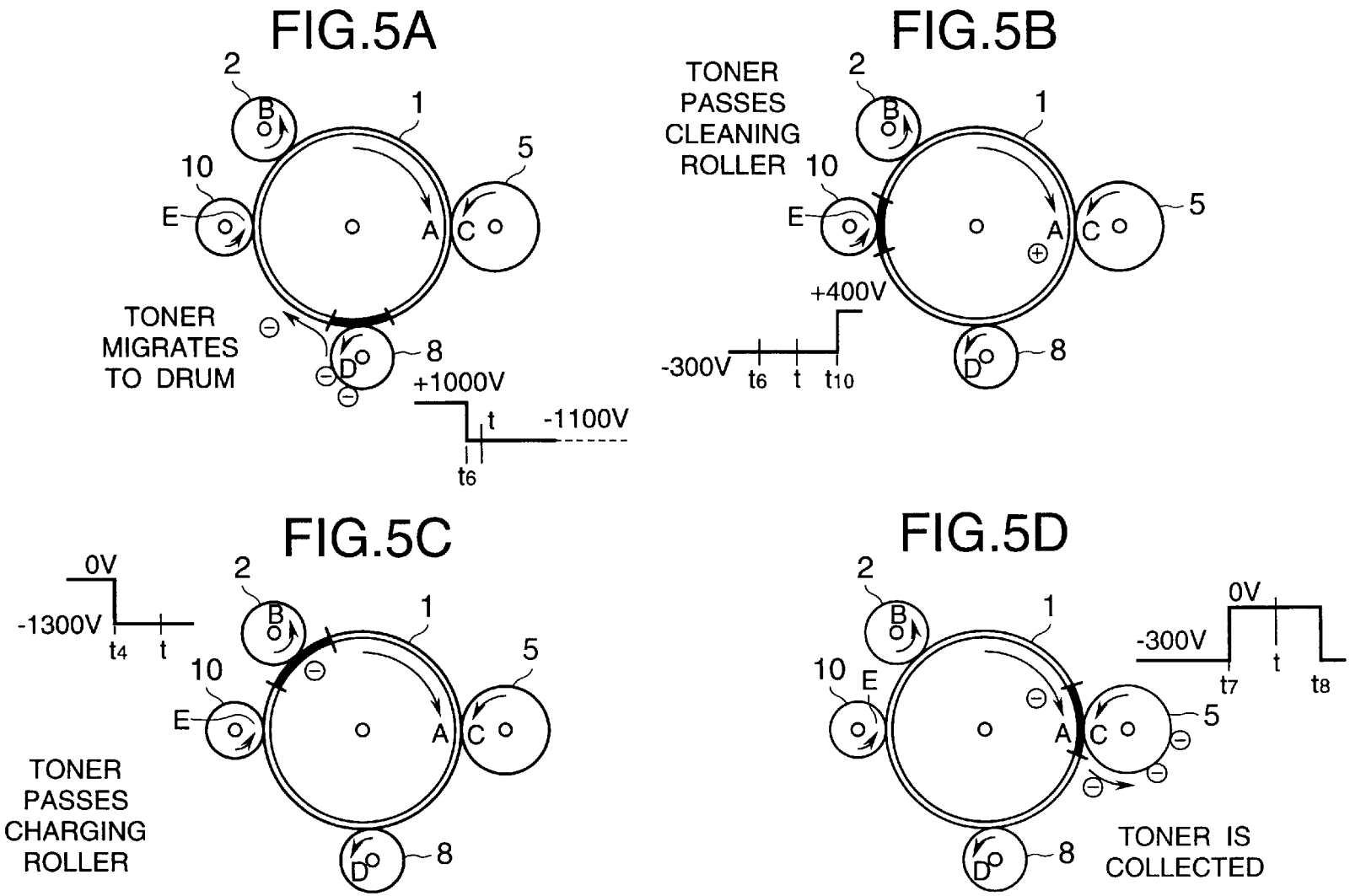
FIGS. 5A–5D illustrate the operation for collecting negatively charged toner from the transfer roller.

Since the transfer roller 8 continues to receive +1000 V until time t6, some of the negatively charged toner, remains on the transfer roller 8. As shown in FIG. 5A, when the transfer roller 8 receives −1100 V at time t6, the Coulomb force attracts the negatively charged toner on the transfer roller 8 to the photoconductive drum 1. Then, the photoconductive drum 1 rotates in the direction shown by arrow A, carrying the negatively charged toner thereon. The negatively charged toner adhering to the photoconductive drum 1 comes into contact with the cleaning roller 10 as shown in FIG. 5B. Since the cleaning roller 10 is receiving −1300 V from the power supply 11, the negatively charged toner on the photoconductive drum 1 remains on the photoconductive drum 1 due to the Coulomb force.

The photoconductive drum 1 further rotates in the direction shown by arrow A so that the surface having the negatively charged toner thereon comes into contact with the charging roller 2 as shown in FIG. 5C. Since the charging roller 2 is receiving −1300 V from the power supply 3, the negatively charged toner remains on the photoconductive drum 1. The photoconductive drum 1 further rotates in the direction shown by arrow A so that, as shown in FIG. 5D, the negatively charged toner on the photoconductive drum 1 comes into contact with developing roller 5 at time t7. At time t7, the output of the power supply 6 is switched from −300 V to zero volts. Thus, the electric field between the photoconductive drum 1 and the developing roller 5 becomes high so that the large Coulomb force attracts the negatively charged toner from the photoconductive drum 1 to the developing roller 5. The supply roller 20 collects negatively charged toner adhering to the developing roller 5 into the developing unit. A voltage of zero volts is applied to the developing roller 5 for a length of time from time t7 to time t8. This length of time is equal to a length of time during which the transfer roller 8 makes one complete rotation. At time t8, the output of the power supply 6 for the developing roller 5 is switched from zero volts to −300 V.

Collecting polarity-inverted toner from the cleaning roller (t6–t9)

The transfer roller 8 receives −1100 V at time t6 so that the photoconductive drum 1 becomes negatively charged after time t6. When the negatively charged surface of the photoconductive drum 1 comes into contact with the cleaning roller 10, the polarity-inverted toner adhering to the cleaning roller 10 is inverted in polarity by triboelectric charging into normally charged toner (negative polarity). The photoconductive drum 1 attracts the thus produced normally charged toner by the Coulomb force. The toner inverted into normal polarity (negative polarity) remains on the photoconductive drum 1 until the developing roller 5 collects it. The output of the power supply 9 is switched from −1100 V to +1000 V at time t9. For the developing roller 5 to most efficiently collect the toner, the period from t6 to t9 during which the polarity-inverted toner is subjected to triboelectric charging should be as long as possible unless the overall printing performance is adversely affected.

When the surface of the photoconductive drum 1 which was in contact with the transfer roller 8 at time t9 comes into contact with the cleaning roller 10 at time t10, the output of the power supply 11 is switched from −1300 V to +400 V. The photoconductive drum 1 makes more than one complete rotation during a period from time t10 to time t11. The cleaning operation is completed at time t11. After time t11, the next printing begins if a continuous printing is being performed, or the motors are turned off if the printing has been completed.

The period from t6 to t9 in the second embodiment is longer than the period from t6 to t7 in the first embodiment so that more polarity-inverted toner can be converted into normally charged toner by the triboelectric charging and collected by the developing roller 5.

The cleaning sequence may be performed every N-th page in the continuous printing mode, and every M-th page in the single-page-printing mode, thereby preventing printing performance from being adversely affected.

The number of pages printed before a cleaning operation is performed may be changed depending on the rate at which the polarity-inverted toner is produced. Selecting appropriate values of N and M provides a best balance of the overall printing performance and the ability to convert the polarity-inverted toner into the normally charged toner (negative polarity).

Third embodiment

A third embodiment is generally of the same structure as the first embodiment and differs from the first embodiment in the cleaning sequence.

Figure 7:
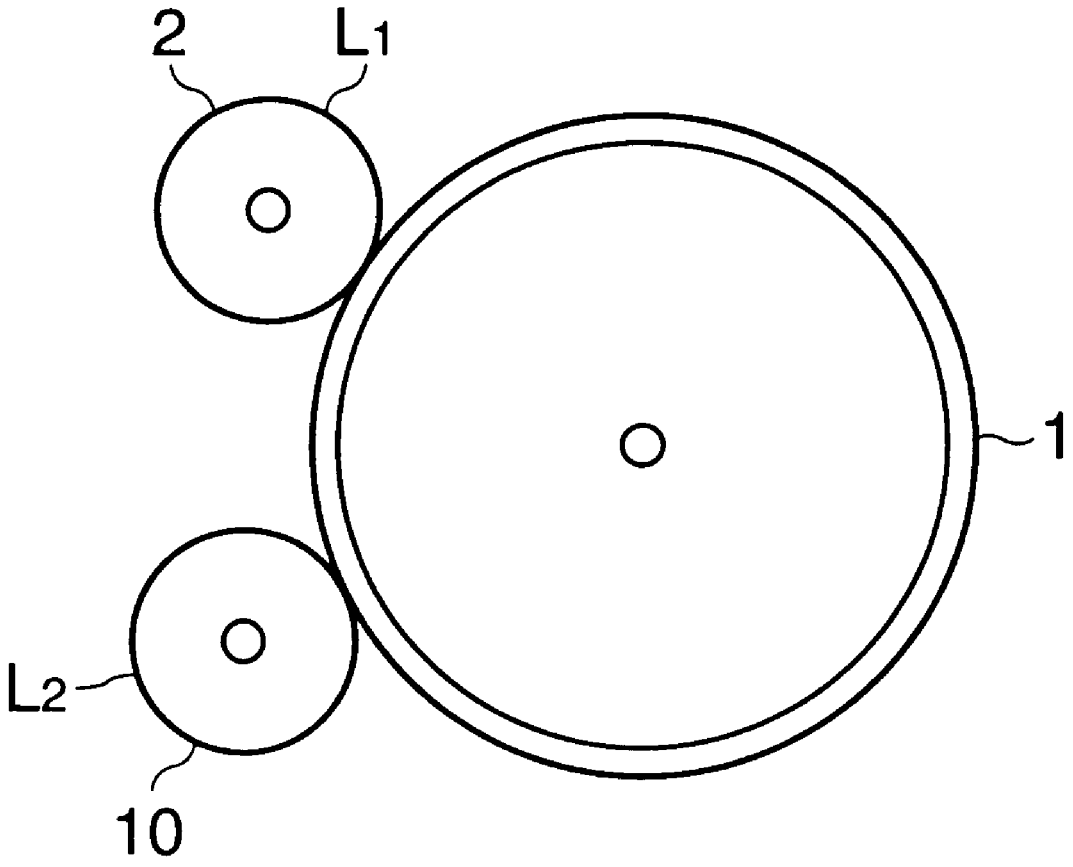
FIG. 7 is a schematic view showing only a photoconductive drum, a charging roller, and a cleaning roller of a third embodiment.

FIG. 7 is a schematic view showing only the photoconductive drum 1, charging roller 2, and cleaning roller 10. FIG. 7 shows the charging roller and cleaning roller when they have the same diameter (L1=L2, A1=A2).

Figure 8:
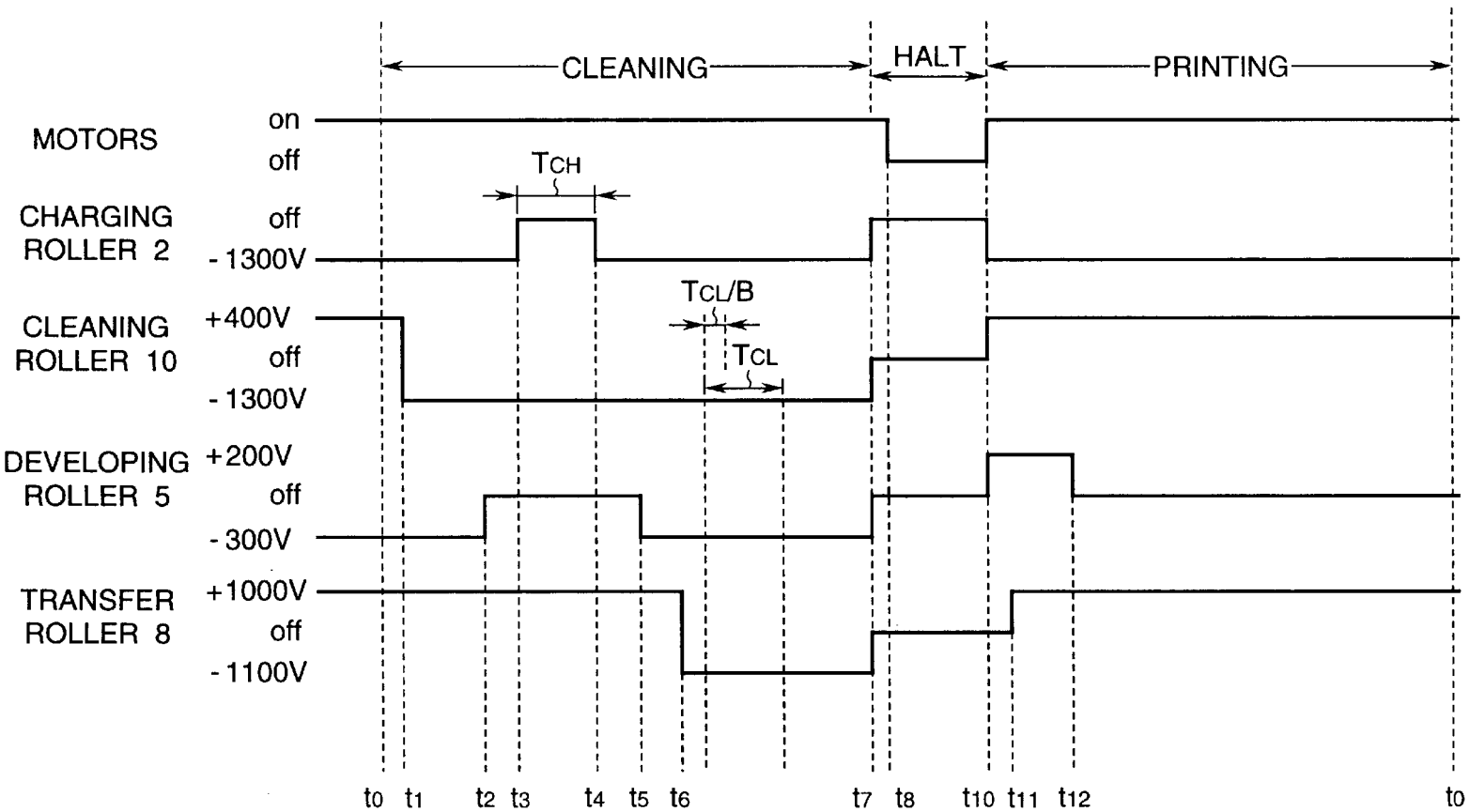
FIG. 8 is a timing chart illustrating the cleaning sequence of the third embodiment and a fourth embodiment.

FIG. 8 is a timing chart illustrating the cleaning sequence of the third embodiment and fourth embodiment.

The surface of the charging roller 2 has a circumferential distance L1. The ratio of the tangential speed of the charging roller 2 to that of the photoconductive drum 1 is denoted at A1. The surface of the cleaning roller 10 has a circumferential distance L2. The ratio of the tangential speed of the cleaning roller 10 to that of the photoconductive drum 1 is denoted at A2. They are related by an equation L1/A1=L2/A2, i.e., the time required for the charging roller 2 to make one complete rotation is equal to the time required for the cleaning roller 10 to make one complete rotation.

The operation of the third embodiment will be described with reference to FIGS. 7 and 8.

After printing one page, the apparatus enters the cleaning operation. During the period from t3 to t4, the photoconductive drum 1 attracts the polarity-inverted toner from the charging roller 2 by the Coulomb force. As the photoconductive drum 1 rotates, the polarity-inverted toner on the photoconductive drum 1 passes the developing roller 5 and transfer roller 8 to the cleaning roller 10. The cleaning roller 10 attracts the polarity-inverted toner by the Coulomb force. Due to the relation of L1/A1=L2/A2, the toner released by the charging roller 2 during one complete rotation ($T_{CH}$ in FIG. 8) of the charging roller 2 migrates to the cleaning roller 10 during one complete rotation ($T_{CL}$ in FIG. 8) of the cleaning roller 10. In other words, $T_{CH}$ is equal to $T_{CL}$.

The output of the power supply 9 for the transfer roller 8 is switched from +1000 V to −1000 V at time t6 so that the photoconductive drum 1 is negatively charged. When the negatively charged surface of the photoconductive drum 1 comes into contact with the cleaning roller 10, no discharge occurs between the photoconductive drum 1 and the cleaning roller 10. However, the polarity-inverted toner is converted into normally charged toner (negatively charged toner) by triboelectric charging and migrates from the cleaning roller 10 to the photoconductive drum 1. The thus produced normally charged toner is brought into contact with the developer roller 5 so that the toner is collected by time t7. If the period from t6 to t7 is long enough, the polarity-inverted toner on the cleaning roller 10 is completely collected. However, the length of period t6–t7 is actually limited by the desired printing speed and therefore some of the polarity-inverted toner still remains on the cleaning roller 10 at the time t7 at which the cleaning operation stops.

When the next printing is started in response to a print command, the power supplies 3, 6, and 11 are turned on at time t10 to provide voltages to the charging roller 2, developing roller 5, and cleaning roller 10, respectively. The charging roller 2 receives −1300 V, the developing roller 5 receives +200 V, and the cleaning roller 10 receives +400 V. When the cleaning roller 10 receives +400 V, the polarity-inverted toner on the cleaning roller 10 that failed to be triboelectrically charged is attracted by the Coulomb force to the photoconductive drum 10. As the photoconductive drum 1 rotates in the direction shown by arrow A, the polarity-inverted toner on the photoconductive drum 1 also rotates to the charging roller 2.

Since the charging roller 2 is receiving −1300 V, the polarity-inverted toner on the photoconductive drum 1 migrates to the charging roller 2. By the aforementioned relation of L1/A1=L2/A2, the polarity-inverted toner that was released from the cleaning roller 10 during one complete rotation of the cleaning roller 10 is attracted from the photoconductive drum 1 to the charging roller 2 during one complete rotation of the charging roller 2. Thus, the surface resistance of the charging roller 2 becomes uniform so that the photoconductive drum 1 is uniformly charged.

As mentioned above, the circumferential distances and tangential speeds of the charging roller 2 and cleaning roller 10 are maintained to hold the relation of L1/A1=L2/A2. This relation allows polarity-inverted toner, which failed to be converted into the normally charged toner, to be uniformly attracted to the charging roller 2 during the following printing so that the toner on the charging roller 2 makes the surface resistance of the charging roller 2 uniform. The uniform surface resistance allows uniform charging of the photoconductive drum 1, thereby providing high quality printed images.

Fourth embodiment

A fourth embodiment is generally of the same structure as the first embodiment and differs from the first embodiment in the cleaning sequence.

Figure 9:
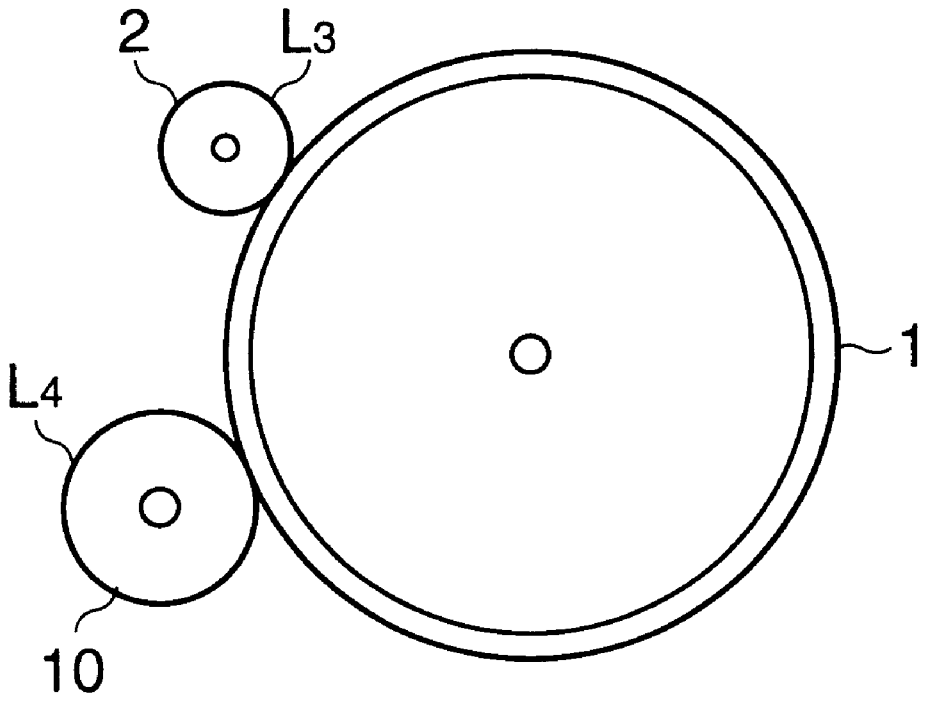
FIG. 9 is a schematic diagram illustrating a photoconductive drum, a charging roller, and a cleaning roller of the fourth embodiment.

FIG. 9 is a schematic diagram illustrating only the photoconductive drum 1, charging roller 2, and cleaning roller 10 of the fourth embodiment. FIG. 9 shows the charging roller and cleaning roller when they have different diameters (L3<L4).

FIG. 8 is a timing chart illustrating the cleaning sequence of the third embodiment and fourth embodiment.

The surface of the charging roller 2 has a circumferential distance L3. The ratio of the tangential speed of the charging roller 2 to that of the photoconductive drum 1 is denoted at A3. The surface of the cleaning roller 10 has a circumferential distance L4. The ratio of the tangential speed of the cleaning roller 10 to that of the photoconductive drum 1 is denoted at A4. They are related by an equation B*L3/A3=L4/A4 (B is a positive integer), i.e., the time required for the charging roller 2 to make one complete rotation is shorter than the time required for the cleaning roller 10 to make one complete rotation.

The operation of the fourth embodiment will be described with reference to FIG. 9 as well as FIG. 2.

After having printed one page of print medium, the apparatus enters the cleaning operation. During the period from t3 to t4, the photoconductive drum 1 attracts the polarity-inverted toner from the charging roller 2 by the Coulomb force. As the photoconductive drum 1 rotates, the polarity-inverted toner on the photoconductive drum 1 passes the developing roller 5 and transfer roller 8 to the cleaning roller 10, which attracts the polarity-inverted toner by the Coulomb force.

The toner released from the charging roller 2 during one complete rotation ($T_{CH}$ in FIG. 8) of the charging roller 2 migrates to the cleaning roller 10, the toner adhering to a longitudinal area of 1/B of the surface area of the cleaning roller 10. This is equivalent in time to 1/B of one complete rotation ($T_{CL}$/B in FIG. 8). It is to be noted that the polarity-inverted toner is not uniformly deposited in the circumferential direction of the cleaning roller 10. However, the triboelectric charging will have spread the polarity-inverted toner more uniformly on the surface of the cleaning roller 10 by the end of the cleaning operation.

The output of the power supply 9 for the transfer roller 8 is switched from +1000 V to −1100 V at time t6, so that the photoconductive drum 1 is negatively charged. When the negatively charged surface of the photoconductive drum 1 comes into contact with the cleaning roller 10, no discharge occurs between the photoconductive drum 1 and the cleaning roller 10. However, the polarity-inverted toner is converted into normally charged toner (negatively charged toner) by triboelectric charging and migrates to the photoconductive drum 1. The normally charged toner is then brought into contact with the developer roller 5 so that the toner is finally collected. If the length of time from t6 to t7 is set to be long enough, the polarity-inverted toner on the cleaning roller 10 is completely collected. However, the length of time from time t6 to time t7 is actually limited by the printing speed and therefore some of the polarity-inverted toner still remains on the cleaning roller 10 when the cleaning operation stops at time t7.

When the next printing is started in response to a print command, the power supplies 3, 6, and 11 are turned on at time t10 to provide voltages to the charging roller 2, developing roller 5, and cleaning roller 10, respectively. The charging roller 2 receives −1300 V, the developing roller 5 receives +200 V, and the cleaning roller 10 receives +400 V. When the cleaning roller 10 receives +400 V, the polarity-inverted toner on the cleaning roller 10 that failed to be triboelectrically charged is attracted by the Coulomb force to the photoconductive drum 1. As the photoconductive drum 1 rotates in the direction shown by arrow A, the polarity-inverted toner on the photoconductive drum 1 also rotates to the charging roller 2.

Since the charging roller 2 is receiving −1300 V, the polarity-inverted toner on the photoconductive drum 1 migrates to the charging roller 2. By the aforementioned relation of B*L3/A3=L4/A4, the polarity-inverted toner that is released from the cleaning roller 10 during one complete rotation of the cleaning roller 10 is attracted from the photoconductive drum 1 to the charging roller 2 and rotates as many as B complete rotations. In other words, the polarity-inverted toner deposited on 1/B of the circumferential area in the rotational direction will be distributed in the rotational direction over one complete rotation.

As mentioned above, the circumferential distances and tangential speeds of the charging roller 2 and cleaning roller 10 are maintained to hold the relation of B*L3/A3=L4/A4. This relation allows polarity-inverted toner on the cleaning roller 10, which failed to be converted into the normally charged toner, to be uniformly attracted to the charging roller 2 during the following printing. Thus, the toner on the charging roller 2 makes the surface resistance of the charging roller 2 uniform. The uniform surface resistance allows uniform charging of the photoconductive drum 1, thereby providing high quality printed image.

Fifth embodiment

A fifth embodiment is of the same structure as the first embodiment except for the operation of the cleaning sequence. The cleaning sequence of according to the fifth embodiment is performed every time a certain number of printed pages have been printed in continuous printing.

Figure 10:
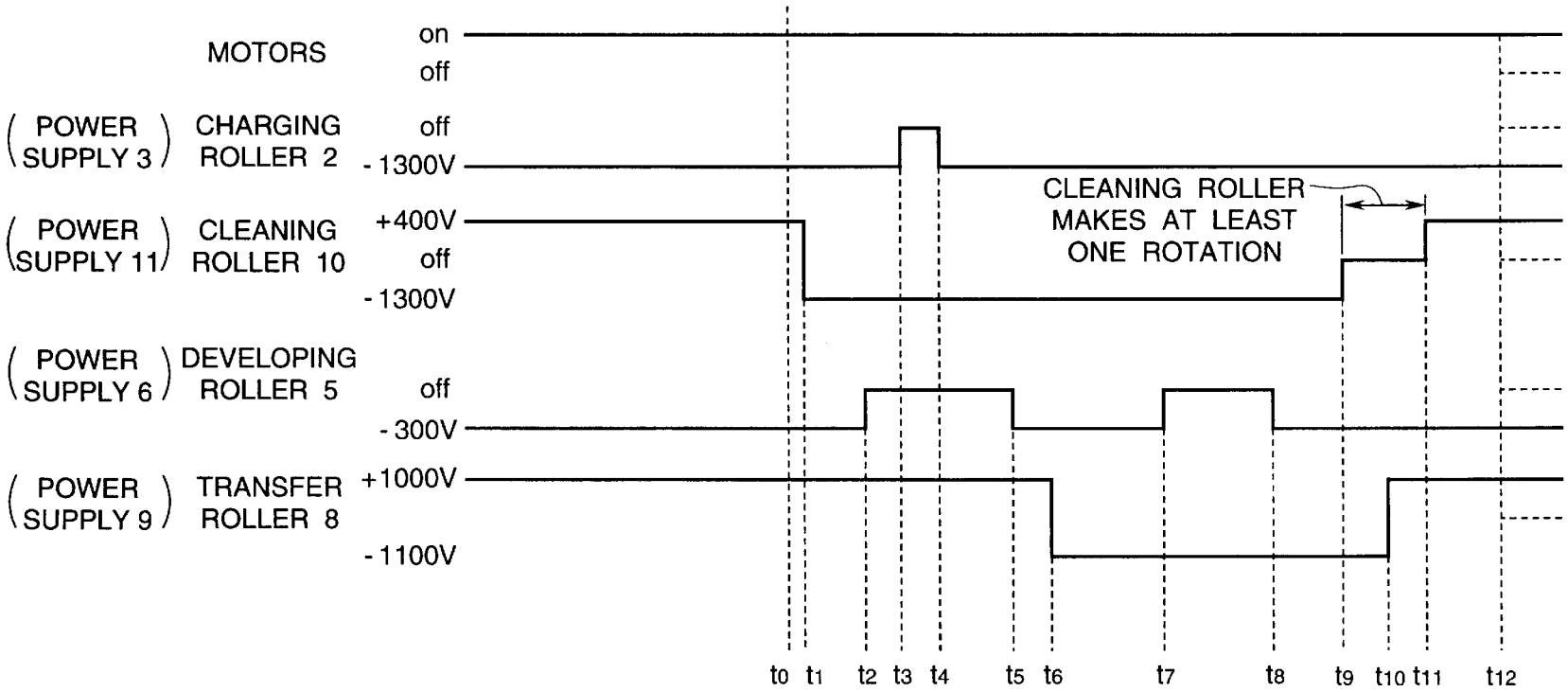
FIG. 10 is a timing chart illustrating a cleaning sequence of a fifth embodiment, performed every N-th page.

FIG. 10 is a timing chart illustrating the cleaning sequence performed every N-th page.

After the printing of the N-th page in the continuous printing mode, the apparatus enters the cleaning sequence shown in FIG. 10. The operation performed from time t0 to time t8 is the same as that of the second embodiment performed from t0 to t8 (FIG. 6). The output of the power supply 11 for the cleaning roller 10 is switched at time t9 from −1300 V to 0 V. The polarity-inverted toner is converted by triboelectric charging into normally charged toner (negatively charged toner) during a period from time t6 to time t9. Thus, this period should be as long as possible unless the overall performance is adversely affected. When the cleaning roller 10 receives zero volts at time t9, the polarity-inverted toner on the cleaning roller 10, which failed to be converted into the normally charged toner, is attracted to the photoconductive drum 1 by the Coulomb force.

The electric field developed between the cleaning roller 10 and the photoconductive drum 1 is weak as compared with the case in which the cleaning roller 10 receives +400 V. The cleaning roller 10 releases less polarity-inverted toner correspondingly. The length of time from t9 to t11 during which the output of the power supply 11 is zero volts is a length of time required for the cleaning roller 10 to make at least one complete rotation. As the photoconductive drum 1 rotates in the direction shown by arrow A, the polarity-inverted toner reaches the charging roller 2. Since the power supply 3 is supplying −1300 V to the charging roller 2, the polarity-inverted toner on the photoconductive drum 1 is attracted to the charging roller 2. The cleaning roller 10 releases only a small amount of polarity-inverted toner and therefore a small amount of polarity-inverted toner is attracted to the photoconductive drum 1.

At time t11, the output of the power supply 11 for the cleaning roller 10 is switched from zero volts to +400 V. Therefore, the electric field developed between the photoconductive drum 1 and the cleaning roller 10 becomes high, so that the polarity-inverted toner remaining on the cleaning roller 10 migrates to the photoconductive drum 1 due to the increased Coulomb force.

As the photoconductive drum 1 further rotates, the polarity-inverted toner reaches the charging roller 2 and is attracted to the charging roller 2. An area of the surface of the photoconductive drum 1 that was in contact with the transfer roller at time t10 comes into contact with the cleaning roller just before time t11. The output voltage of the power supply 9 for the transfer roller 8 is switched from −1100 V to +1000 V at time t10. The cleaning operation completes at time t12 and the apparatus enters the printing operation for subsequent pages.

As mentioned above, the polarity-inverted toner on the cleaning roller 10 does not migrate to the charging roller 2 in a single step but in two steps. Therefore, even if a large amount of polarity-inverted toner adheres to the charging roller 2, the polarity-inverted toner may be more uniformly deposited on the surface of the charging roller 2. As a result, the photoconductive drum 1 is more uniformly charged, providing high print quality.

The operation of the fifth embodiment is also effective in the single-page-printing mode if a large amount of toner adheres to the charging roller 2.

Sixth embodiment

A sixth embodiment is generally of the same structure as the first embodiment and will be described with respect to only a part different from the first embodiment.

Figure 11:
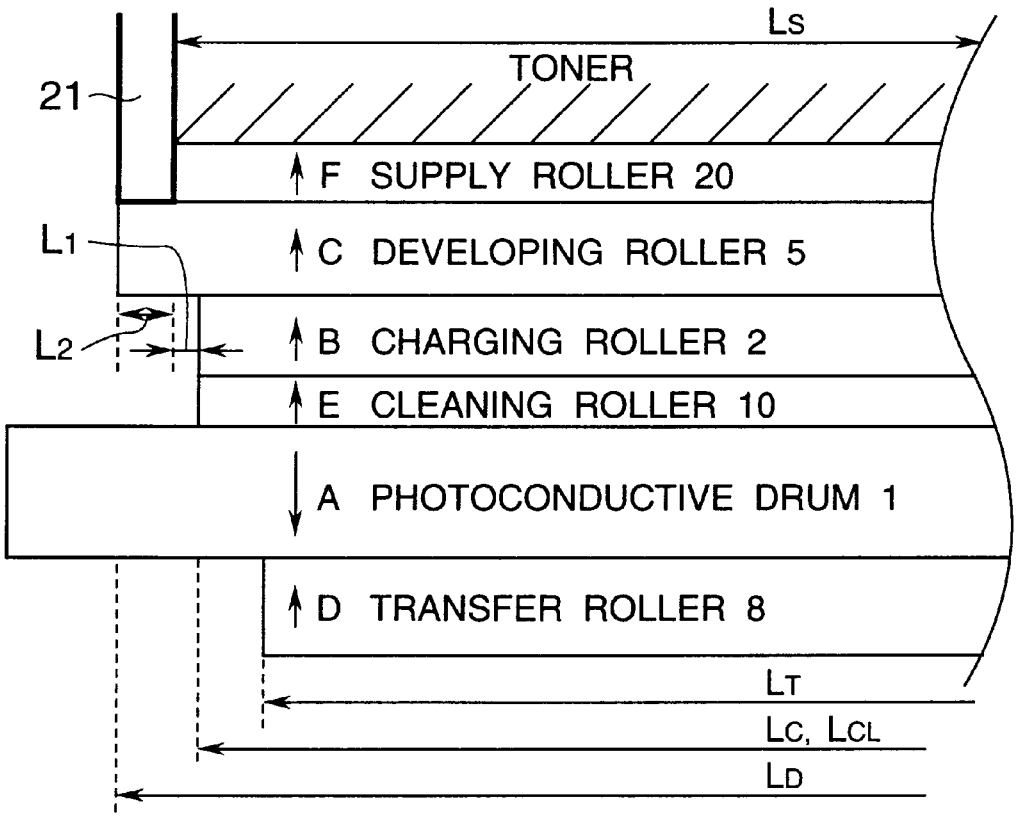
FIG. 11 is a side view of an image forming apparatus according to a sixth embodiment, showing the positional relation of the rollers.

FIG. 11 is a side view of the apparatus, showing only the positional relationship between the ends of respective rollers.

The toner is charged by a supply roller 20 and is supplied to the developing roller 5. A sealing portion 21 prevents the toner from leaking through the end portion of the supply roller 20.

The charging roller 2, developing roller 5, supply roller 20, cleaning roller 10, and transfer roller 8 have lengths $L_C$, $L_D$, $L_S$, $L_{CL}$ and $L_T$, respectively, between their centers and one of their respective ends. The lengths are related by $L_D>L_S>L_C=L_{CL}>L_T$. The actual print region is shorter than the length $L_T$. The supply roller 20 extends a distance L1 beyond the charging roller 2 and the sealing portion 21 is located beside the end of the supply roller 20 and extends over a distance L2.

The photoconductive drum 1, charging roller 2, developing roller 5, transfer roller 8, cleaning roller 10, and supply roller 20 rotate in directions shown by arrows A, B, C, D, E, and F. The charging roller 2 charges only an area of the photoconductive drum 1 that is in contact with the charging roller 2. Therefore, an area of the photoconductive drum 1 extending over distances L1 and L2 is not charged. Insufficiently charged toner, including polarity-inverted toner, leak through interface between the supply roller 20 and the sealing portion 21. However, the surface of the photoconductive drum 1 extending over a distance L1+L2 is not charged and therefore the polarity-inverted toner remains attracted to the developing roller 5.

The negatively charged toner is attracted to the uncharged surface of the photoconductive drum 1. Thus, the negatively charged toner is deposited on the uncharged surface of the photoconductive drum 1 extending over the distance L. Since neither the charging roller 2 nor the cleaning roller 10 is in contact with this surface area (L1) of the photoconductive drum 1, the negatively charged toner will not migrate to an area outwardly beyond the distance L1. When an amount of the negatively charged toner deposited on the photoconductive drum 1 increases, the potential of toner on the photoconductive drum 1 becomes close to the potential of an area of the developing roller 5 extending over the distance LI, the potentials reaching equilibrium. As a result, there will be no further migration of negatively charged toner from the developing roller 5 to the photoconductive drum 1.

Some of the polarity-inverted toner and some of the negatively charged toner migrate to the photoconductive drum 1 and adhere to the charging roller 2 and cleaning roller 10 over the length $L_C$. Performing the cleaning operations according to the first and second embodiments prevents the negatively charged toner and polarity-inverted toner from adhering to the photoconductive drum 1.

Insufficiently charged toner including the polarity-inverted toner may leak through the interface between the supply roller 20 and the sealing portion 21. Such leaked toner simply adheres to the photoconductive drum 1 but not to the charging roller 2. Therefore, such leaked toner is not detrimental to the uniform charging of the photoconductive drum 1 and to maintaining good print quality.

Seventh embodiment

A seventh embodiment is of the same structure as the first embodiment except for the operation of the controller.

Figure 12:
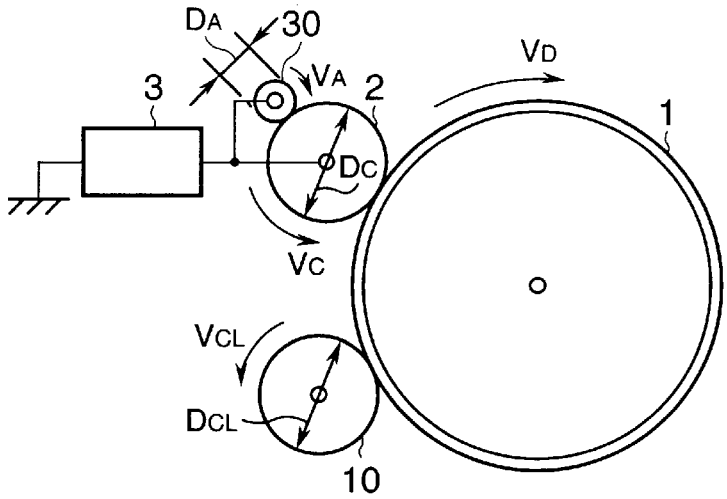
FIG. 12 is a schematic view showing only a photoconductive drum, a charging roller, a cleaning roller, and an auxiliary roller of a seventh embodiment.

FIG. 12 is a schematic view showing only the photoconductive drum 1, charging roller 2, cleaning roller 10, and auxiliary roller 30.

The cleaning sequence is the same as the third or fourth embodiment and will be described briefly with reference to FIG. 12.

As a result of the cleaning sequence, the toner removed from the charging roller 2 adheres to the negatively charged cleaning roller 10. When a printing is started after the cleaning sequence, the cleaning roller 10 receives +400 V so that the toner adhering to the cleaning roller 10 migrates to the photoconductive drum 1 and then to the surface of the charging roller 2.

The toner which migrates from the charging roller 2 to the photoconductive drum 1 during the cleaning sequence adheres to the surface of the photoconductive drum 1 over a circumferential distance S1. This distance S1 is given by the following equation.

$$S1=(\pi\cdot D_C+\pi\cdot D_A\cdot VC/V_A)V_D/V_C \quad (1)$$

where DC is the outer diameter of the charging roller 2, $V_C$ is the rotational speed of the charging roller 2, $D_A$ is the outer diameter of the auxiliary roller 30, $V_A$ is the rotational speed of the auxiliary roller 20, $D_L$ is the outer diameter of the cleaning roller 10, $V_{CL}$ is the rotational speed of the cleaning roller 10, and $V_D$ is the rotational speed of the photoconductive drum 1.

The toner that migrates from the cleaning roller 10 to the photoconductive drum 1 after the cleaning sequence adheres to the surface of the photoconductive drum 1 over a circumferential distance S2. This distance S2 is given by the following equation.

$$S2=(\pi\cdot D_{CL})V_D/V_{CL} \quad (2)$$

Then, the outer diameters and rotational speeds of the charging roller, auxiliary roller 30, and cleaning roller 10 are selected such that S1=S2. Thus, the following relation is derived.

$$(D_C+D_A\cdot V_C/V_A)/V_C=D_{CL}/V_{CL} \quad (3)$$

Equation (3) implies that the distance over which the cleaning roller 10 rolls on the surface of the photoconductive drum is equal to the sum of one complete circumferential distance of the charging roller 2 and one complete circumferential distance of the auxiliary roller 30.

Thus, the amount of toner removed from the charging roller 2 during the cleaning sequence is equal to the amount of toner that migrates from the cleaning roller 10 to the photoconductive drum 1 after the cleaning sequence. This relation allows the toner to uniformly re-adhere to the charging roller 2.

As mentioned above, after the cleaning sequence, the toner is returned from the cleaning roller 10 to the photoconductive drum 1 and uniformly adheres to the charging roller 2. This eliminates variations in the charging of the photoconductive drum 1 resulting from the variations in the deposition of the toner, thereby allowing uniform charging of the photoconductive drum.

Eighth embodiment

An eighth embodiment is of the same structure as the first embodiment.

Figure 13:
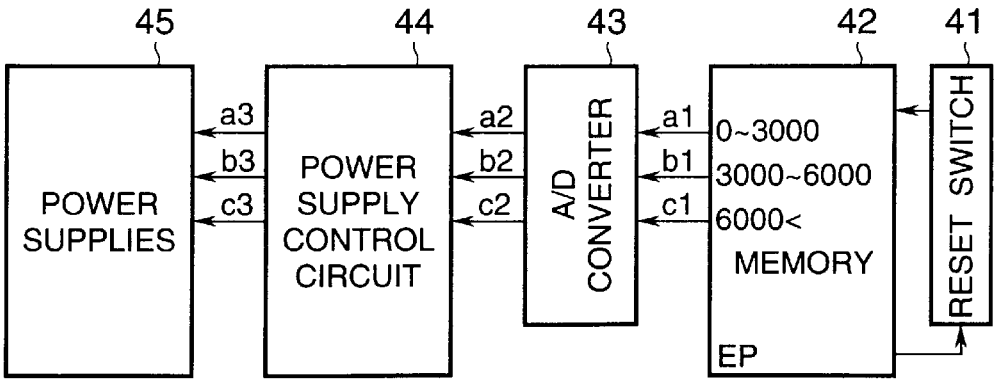
FIG. 13 is a block diagram illustrating the flow of signals for controlling voltages applied to respective rollers of an eighth embodiment.

FIG. 13 is a block diagram that illustrates the flow of signals for controlling the output voltages of the respective power supplies of the eighth embodiment.

Figure 14:
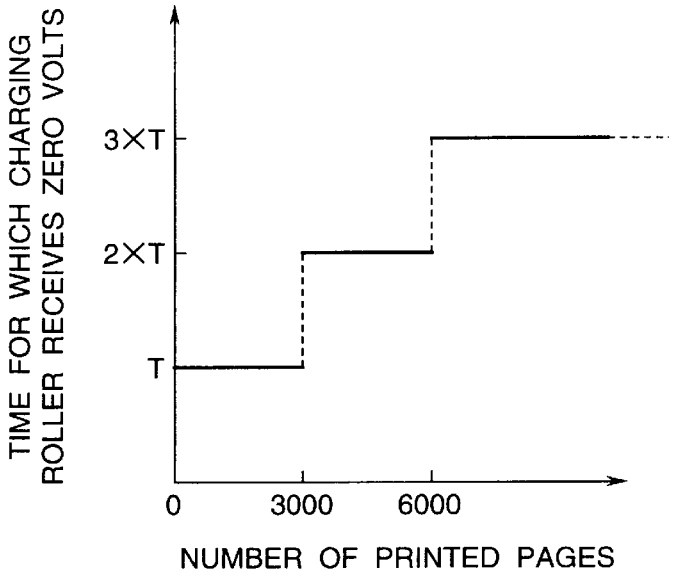
FIG. 14 illustrates the relationship between the number of printed pages and the time for which the charging roller receives zero volts.

FIG. 14 illustrates the relation between the number of printed pages and the time for which the charging roller receives zero volts.

The cleaning sequence of the eighth embodiment is basically the same as that of the second embodiment shown in FIG. 6 and differs in that the voltage applied to the charging roller is progressively higher as the number of printed pages increases.

A memory 42 generates a count signal a1 if the number of printed pages is in the range from 0 to 3000. A D/A converter 43 converts the count signal a1 from a digital signal into an analog signal a2. A power supply controller 44 receives the analog signal a2 and provides a power supply control signal a3 to respective power supplies 45, the power supply control signal a3 specifying a length of time T for which a voltage of zero volts is output from a corresponding power supply. In response to the analog signal a3, the respective power supplies provide zero volts to corresponding rollers. For example, the power supply 3 applies a voltage of zero volts to the charging roller 2 for a length of time T1 in the cleaning sequence.

Likewise, the memory 42 generates a drum count signal b1 if the number of printed pages is in the range from 3000 to 6000. The power supply controller 44 provides a power supply control signal b3 to respective power supplies 45, the power supply control signal b3 specifying a length of time 2×T for which a voltage of zero volts is output. In response to the analog signal b3, the respective power supplies provide zero volts to the corresponding rollers, e.g., the charging roller 2 for time 2×T in the cleaning sequence as shown in FIG. 14. When the number of printed pages exceeds 6000, the charging roller receives a voltage of zero volts for time 3×T.

Extending the time for which the charging roller receives a voltage of zero volts means that the other power supplies continue to provide their output for a correspondingly extended time. Referring to FIG. 6, if the timing t4 is delayed, then the timings at which the outputs of the other power supplies are switched after time t4 are also delayed correspondingly.

When the photoconductive drum 1 is replaced, the user operates a reset switch 41 to clear the content of the memory 42.

In the eighth embodiment, the time for which the charging roller 2 receives a voltage of zero volts is set to 3×T or less. Therefore, when a cleaning sequence is to be carried out after printing, for example, ten pages of print medium, there is not too long a time before the printing of eleventh page is started. Of course, the time for which the charging roller receives a voltage of zero volts may be set to an appropriate length in accordance with printing speed, toner, and material of charging roller.

As mentioned above, changing the time for which the charging roller receives a voltage of zero volts in accordance with the number of printed pages allows efficient removal of the toner from the charging roller even when a large amount of toner adheres to the charging roller. Optimizing the length of time prevents poor charging resulting from "toner filming".

Ninth embodiment

A ninth embodiment is of the same structure as the first embodiment except for the operations of the controller and the power supply for the charging roller.

Figure 15:
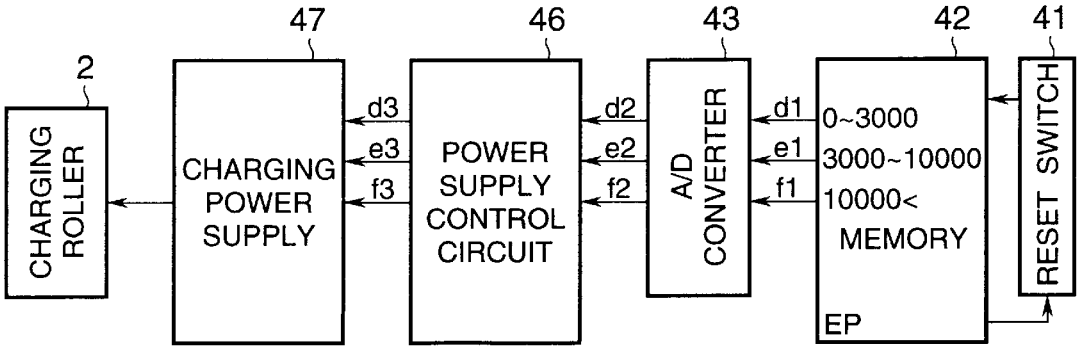
FIG. 15 is a block diagram illustrating the flow of signals for controlling voltages applied to respective rollers of a ninth embodiment

FIG. 15 is a block diagram that illustrates the flow of signals for controlling the output voltages of the respective power supplies.

Figure 16:
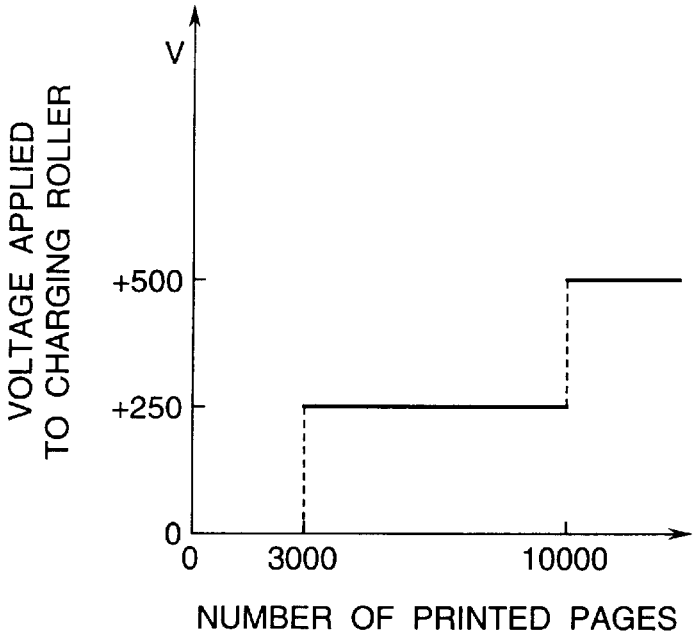
FIG. 16 illustrates the relationship between the number of printed pages and the voltage applied to the charging roller.

FIG. 16 illustrates the relationship between the number of printed pages and the voltage applied to the charging roller. The sequence is carried out in the same way as the second embodiment.

A memory 42 provides a count signal d1 for the number of printed pages in the range from 0 to 3000. A D/A converter converts the count signal d1 from a digital signal to an analog signal. The analog signal d2 is received by a power supply control circuit 44, which in turn provides a power supply control signal d3, which specifies an output voltage of zero volts, to a power supply 47. Thus, as shown in FIG. 16, the power supply 47 applies a voltage of zero volts to the charging roller 2 in the cleaning sequence in response to the power supply control signal d3.

Similarly, the memory 42 provides a count signal e1 for the number of printed pages in the range from 3000 to 6000. The power control circuit 44 provides a power supply control signal e3, which specifies an output voltage of +250 V, to the power supply 47, which in turn applies a voltage of +250 V to the charging roller 2 during the cleaning sequence. Likewise, the power supply 47 applies a voltage of +500 V to the charging roller 2 during the cleaning sequence.

Shortly after the photoconductive drum 1 has been replaced, the user operates the reset switch 41 to clear the content of the memory 42. Although the maximum voltage applied to the charging roller 2 is selected to be +500 V so that the charging of the photoconductive drum 1 is not adversely affected, the voltage may be set in accordance with the printing speed of the printer, toner, and material of the charging roller.

As mentioned above, changing the time for which the charging roller 2 receives a voltage of zero volts in accordance with the number of printed pages allows efficient removal of the toner from the charging roller 2 even when a large amount of toner adheres to the charging roller. This operation prevents poor charging of the photoconductive drum 1 resulting from "toner filming".

Tenth embodiment

A tenth embodiment is of the same structure as the first embodiment except for the power supply for the charging roller and controller.

Figure 17:
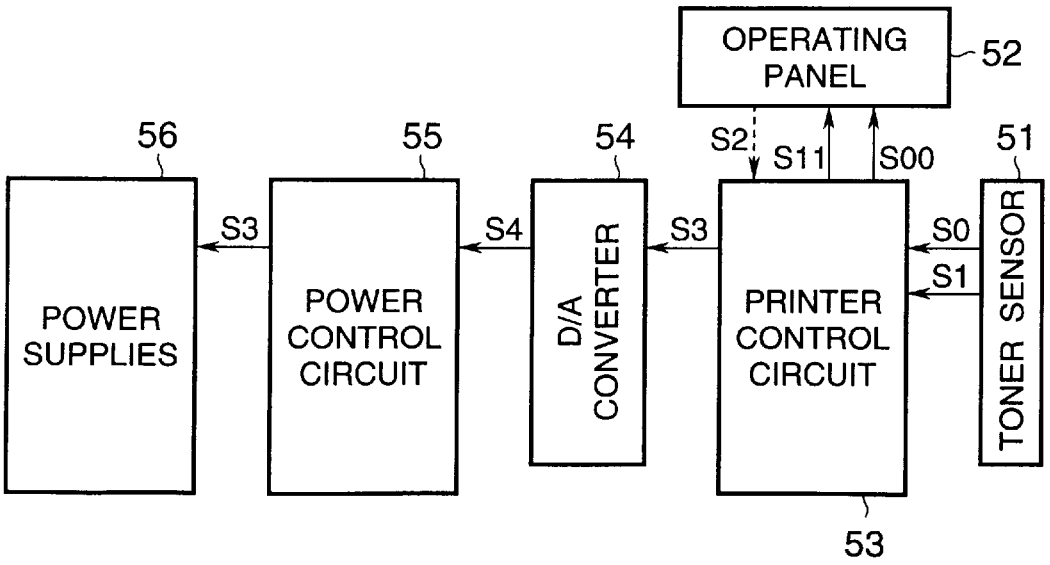
FIG. 17 is a block diagram illustrating the flow of signals for controlling output voltages of a power supply according to a tenth embodiment.

FIG. 17 is a block diagram illustrating the flow of signals for controlling the respective blocks.

A toner sensor 51 detects the remaining toner in a toner tank provided in the image forming apparatus and shows a message such as "Please replace toner" on an operation panel 52. A print control circuit 53 transmits and receives signals to and from the operation panel 52 to perform the printing operation. A D/A converter 54 converts the digital signals generated by the print control circuit 53 into analog signals. A power supply control circuit 55 generates a selector signal for selecting voltages in response to the analog signals outputted from the D/A converter 54. In response to the selector signal, the power supplies 56 provide voltages to the respective rollers.

Figure 18:
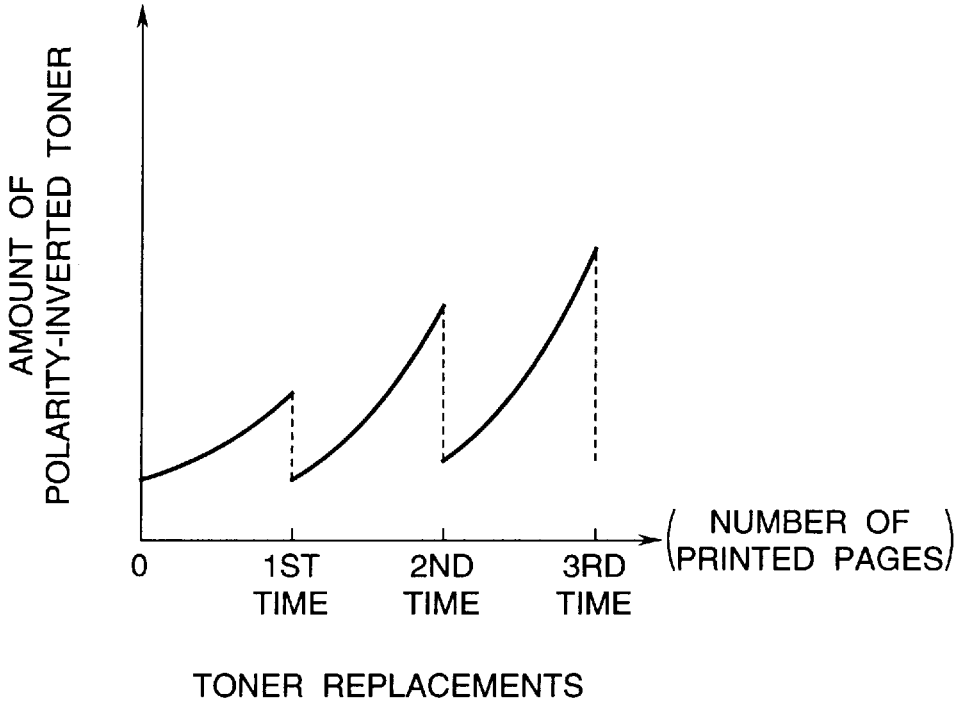
FIG. 18 illustrates the relationship between the number of printed pages and the amount of polarity-inverted toner adhering to the photoconductive drum.
Figure 19:
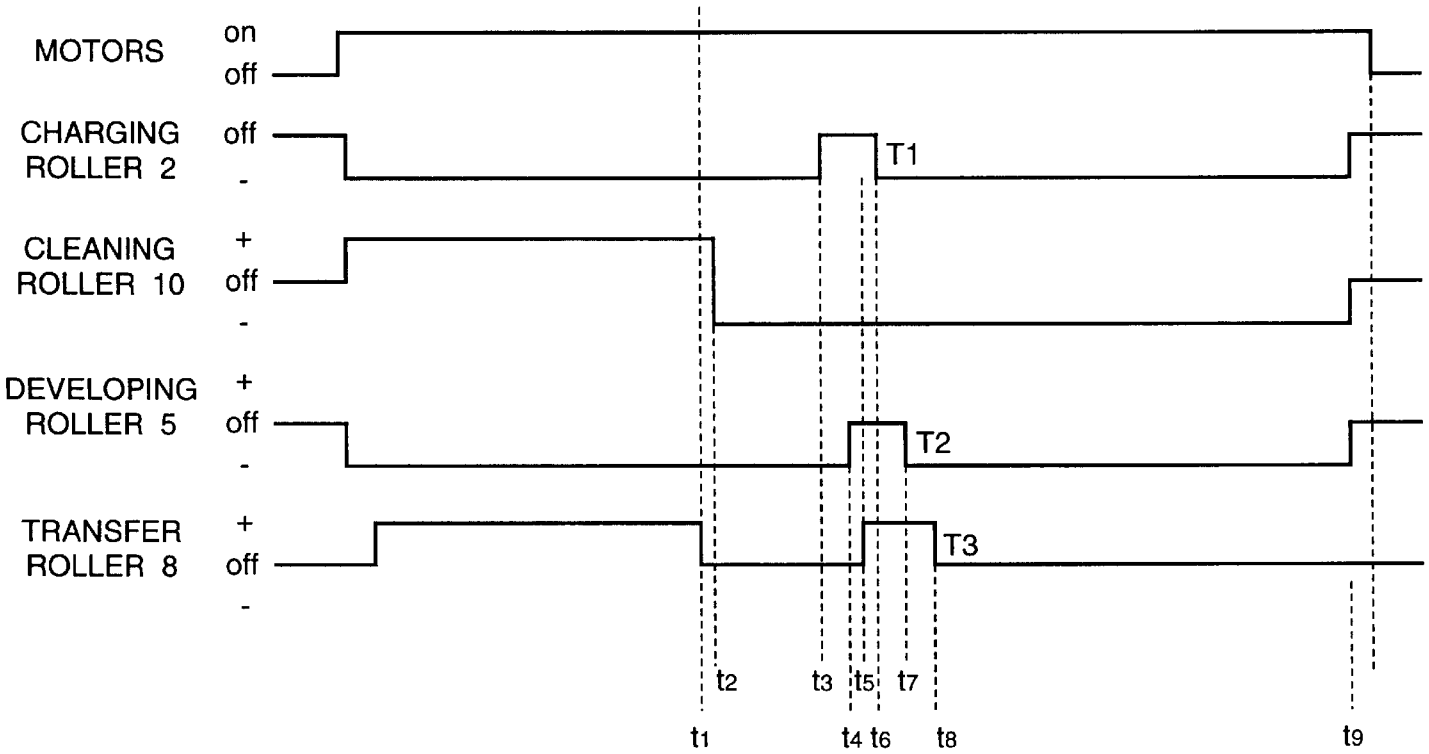
FIG.19 CONVENTIONAL ART
FIG. 19 is a timing chart illustrating a conventional cleaning sequence for the image forming apparatus of FIG. 2.

FIG. 18 illustrates the relationship between the number of printed pages and the amount of polarity-inverted toner adhering to the photoconductive drum.

The toner sensor 51 that detects the remaining toner in the toner tank provides a toner-low signal S0 to the print control circuit 53. The print control circuit 53 provides a display signal S00 to the operation panel 52, so that the operation panel displays a message such as "Please replace toner" prompting the user to replace toner. Thereafter, the apparatus enters the sequence routine that performs a "dummy printing" for a cleaning purpose.

The sequence routine includes the following steps.

The cleaning roller 10 receives a negative voltage to charge the photoconductive drum 1 after the toner has been replaced. Then, the charging roller 2 receives a voltage of zero volts or a positive voltage, to release the polarity-inverted toner therefrom. It is to be noted that the charge surface of the photoconductive drum 1 is not exposed to light. The transfer roller 8 receives a negative voltage so that the polarity-inverted toner is transferred to the print medium.

Upon completion of the toner replacement, the toner sensor generates and provides to the print control circuit 53 a replacement-completion signal S1 indicating that the toner has been replaced. The print control circuit 53 then provides a display signal S11 to the operation panel 52 while also performing the dummy printing for cleaning. During the dummy printing, the print control circuit 53 displays a message indicating that normal printing operation is prohibited. When the operation panel 52 outputs a dummy print signal S2 indicative of the dummy printing for a cleaning purpose, the print control circuit 53 provides a digital signal S3 to the D/A converter 54 which in turn converts the digital signal S3 into an analog signal S4. In response to the analog signal S4, the power supply control circuit 55 provides power supply control signal S5 to the power supplies 56. The print control circuit 53 controls the printing operation to perform the dummy printing for the cleaning purpose.

Combining the dummy printing with the respective embodiments will improve the cleaning effect.

During the dummy printing, the charging roller 2 should receive a voltage of zero volts for a sufficiently long time. An experiment showed that when the time period T1 described in the eighth embodiment is increased to 5×T1, the polarity-inverted toner could be more efficiently removed from the charging roller 2. The toner can be removed even more effectively if the dummy printing is performed every time a predetermined number of printed pages, for example 1000 pages, have been printed.

The cleaning sequence according to the tenth embodiment is longer in time than other embodiments, so that a large amount of toner can be sufficiently removed from the charging roller 2 and then transferred to the print medium, which is then discharged from the image forming apparatus. Therefore, there is no chance of the removed toner adhering to the charging roller 2 again. This ensures that the residual toner can be efficiently removed, preventing poor charging of the photoconductive drum resulting from "toner filming." The dummy printing for cleaning purpose, longer than the cleaning sequences of the other embodiments, allows sufficient agitating of the fresh toner, further ensuring good print quality.

The present invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A method of cleaning an image forming apparatus having photoconductor, a charging roller and a cleaning roller, the method comprising the steps of:

applying a first voltage having a first polarity to at least the charging roller to which toner having a second polarity opposite to the first polarity is adhering;

charging a surface of the photoconductor with a cleaning device or a transfer device to a second voltage having the first polarity, the second voltage having a smaller absolute value than the first voltage and being of a same polarity as the first voltage; and converting the toner having the second polarity sandwiched between the surface of the photoconductor and the at least the charging roller into toner having the first polarity.

2. The method according to claim 1, wherein the first voltage also is applied to the cleaning roller.

3. A method of cleaning an image forming apparatus having a photoconductor, a charging roller, a developing roller, a transfer roller, and a cleaning roller, all of which rotating in predetermined directions and receiving corresponding voltages in sequence as the photoconductor rotates, the method comprising the steps of:

causing a first toner of a first polarity adhering to the cleaning roller to migrate to the surface of the photoconductor so that the surface of the photoconductor passes the charging roller while carrying the first toner on the surface of the photoconductor and reaches the developing roller;

causing a second toner of a second polarity opposite to the first polarity adhering to the charging roller to migrate to the surface of the photoconductor so that the surface of the photoconductor passes the developing roller and transfer roller while carrying the second toner on the surface of the photoconductor and reaches the cleaning roller, the cleaning roller converting the second toner into a third toner of the first polarity, the surface of the photoconductor reaching the developing roller after the second toner is converted into the third toner;

causing a fourth toner of the first polarity adhering to the transfer roller to migrate to the surface of the photoconductor so that the surface of the photoconductor passes the cleaning roller and charging roller while carrying the fourth toner of the first polarity on the photoconductor and reaches the developing roller; and collecting the first toner, second toner, third toner, and fourth toner with the developing roller.

4. The method according to claim 3, wherein a cleaning is performed after each page of print medium has been printed.

5. The method according to claim 3, wherein a cleaning is performed after a certain number of pages of print medium have been printed.

6. The method according to claim 3, wherein the charging roller and cleaning roller are related by $$L1/A1=L2/A2$$

where L1 is a circumference of the charging roller, L2 is a circumference of the cleaning roller, A1 is a ratio of a circumferential speed of the charging roller to that of the photoconductor, and A2 is a ratio of a circumferential speed of the cleaning roller to that of the photoconductor.

7. The method according to claim 3, wherein the charging roller and cleaning roller are related by $$B*L3/A3=L4/A4$$

where L3 is a circumference of the charging roller, L4 is a circumference of the cleaning roller, A3 is a ratio of a circumferential speed of the charging roller to that of the photoconductor, A4 is a ratio of circumferential speed of the cleaning roller to that of the photoconductor, and B is an integer.

8. The method according to claim 3, wherein the image forming apparatus further includes a supply roller that supplies toner to the developing roller, and the developing roller, supply roller, charging roller, cleaning roller, and transfer roller are related by $$L_D>L_S>L_C=L_{CL}>L_T$$

where $L_D$ is a length of the developing roller, $L_S$ is a length of the supply roller, $L_C$ is a length of the charging roller, $L_{CL}$ is a length of the cleaning roller, and $L_T$ is a length of the transfer roller.

9. The method according to claim 3, wherein the image forming apparatus further includes an auxiliary charging roller rotating in contact with the charging roller; and wherein the charging roller, auxiliary roller, developing roller, supply roller, charging roller, cleaning roller, and transfer roller are related by $$(D_C+D_A\cdot V_C/V_A)/V_C=D_{CL}/V_{CL}$$

where $D_C$ is a diameter of the charging roller, DA is a diameter of the auxiliary roller, $D_{CL}$ is a diameter of the cleaning roller, $V_C$ is a rotational speed of the charging roller, $V_A$ is a rotational speed of the auxiliary roller, and $V_{CL}$ is a rotational speed of the cleaning roller.

10. The method according to claim 3, further comprising the step of applying a voltage of substantially zero volts to the charging roller, the voltage being applied for a length of time in accordance with a number of printed pages.

11. The method according to claim 3, further comprising the step of applying a voltage to the charging roller for a certain length of time, the voltage being changed in value in accordance with a number of printed pages.

12. A method of cleaning an image forming apparatus comprising the steps of:

applying a negative voltage to a cleaning roller to charge a photoconductor;

applying a voltage of zero volts or a positive value to a charging roller so that toner having a polarity opposite to a toner image migrates to the photoconductor; and applying a negative voltage to a transfer roller so that the toner that has migrated to the photoconductor is transferred to a print medium.

13. The method according to claim 12, wherein applying the negative voltage to the transfer roller is performed after a certain number of pages of print medium have been printed.

* * * * *